US010302381B1

(12) United States Patent
Huang

(10) Patent No.: US 10,302,381 B1
(45) **Date of Patent: *May 28, 2019**

(54) MAGAZINE RELEASE BLOCKING ELEMENT

(71) Applicant: George Huang, Henderson, NV (US)

(72) Inventor: George Huang, Henderson, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/953,468

(22) Filed: Apr. 15, 2018

Related U.S. Application Data

(62) Division of application No. 15/347,616, filed on Nov. 9, 2016, now Pat. No. 10,060,690.

(60) Provisional application No. 62/356,623, filed on Jun. 30, 2016.

(51) Int. Cl.
*F41A 17/38* (2006.01)
*F41A 9/59* (2006.01)
*F41A 3/66* (2006.01)

(52) U.S. Cl.
CPC . *F41A 9/59* (2013.01); *F41A 3/66* (2013.01)

(58) Field of Classification Search
CPC .. F41A 17/38; F41A 17/44; F41A 3/66; F41A 9/59; F41C 23/04; F41C 23/10
USPC ..... 42/70.11, 6, 69.01, 71.02, 70.01
See application file for complete search history.

(56) References Cited

U.S. PATENT DOCUMENTS 4,528,765 A * 7/1985 Johnson ..... F41A 17/44 42/70.05
4,709,496 A * 12/1987 Johnson ..... F41A 17/44 42/1.05
5,149,898 A * 9/1992 Chesnut ..... F41A 9/65 42/69.01
5,241,769 A * 9/1993 Von Muller ..... F41A 17/44 42/70.04
5,272,957 A * 12/1993 Chesnut ..... F41A 9/65 42/69.03
5,519,954 A * 5/1996 Garrett ..... F41A 17/38 42/6
9,518,792 B1 * 12/2016 Huang ..... F41A 35/00
2014/0013640 A1 * 1/2014 Munson ..... F41A 17/38 42/6
2014/0360076 A1 * 12/2014 Zamlinsky ..... F41C 23/20 42/75.03
2015/0047244 A1 * 2/2015 Tusting ..... F41C 23/04 42/71.02
2015/0377575 A1 * 12/2015 Potter ..... F41A 17/52 42/69.01
2016/0047610 A1 * 2/2016 Pittman ..... F41A 9/18 42/17

(Continued)

*Primary Examiner* — Michael D David
(74) *Attorney, Agent, or Firm* — Shaddock Law Group, PC

(57) ABSTRACT

A magazine release block including a blocking element and a lower receiver of a firearm, wherein the lower receiver comprises a blocking element channel extending between an upper surface of the lower receiver and a magazine release button receiving cavity, wherein the blocking element is positioned within the blocking element channel, and wherein the blocking element is movable between a disengaged position wherein the blocking element does not inhibit movement of a magazine release button and an engaged position wherein at least a portion of the blocking element inhibit movement of a magazine release button, and wherein when an upper receiver of the firearm is operably positioned atop the lower receiver a surface of the upper receiver urges the blocking element to the engaged position.

4 Claims, 23 Drawing Sheets

(56) References Cited

U.S. PATENT DOCUMENTS

2016/0076851 A1* 3/2016 Tusting ..... F41C 3/14
42/71.02

* cited by examiner

MAGAZINE RELEASE BLOCKING ELEMENT

CROSS-REFERENCE TO RELATED APPLICATIONS

This patent application is a divisional of U.S. patent application Ser. No. 15/347,616, filed Nov. 9, 2016, which claims the benefit of U.S. Patent Application Ser. No. 62/356,623, filed Jun. 30, 2016, the disclosures of which are incorporated herein in their entireties by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE DISCLOSURE

1. Field of the Disclosure

The present disclosure relates generally to the field of firearms. More specifically, the present disclosure relates to a magazine release block adaptable to be used with a firearm, such as, for example, an AR-15 or M4, Fusil Automatique Léger (FAL), Special Operations Forces Combat Assault Rifle (SCAR) style firearm, and the like.

2. Description of Related Art

Various firearms comprise certain components that are held together by one or more pins being releasably secured within apertures of the various components. Certain such firearm are the AR-15 or M4, the Fusil Automatique Lëger (FAL), and the Special Operations Forces Combat Assault Rifle (SCAR) style firearm.

By way of example, the AR-15 is based on the AR-10, which was designed by Eugene Stoner, Robert Fremont, and L. James Sullivan of the Fairchild ArmaLite Corporation in 1957. Today, there are numerous variants of the AR-15 that are manufactured by a number of companies. The AR-15 and its various related derivative platforms are used by civilians, law enforcement personnel, and military forces around the world.

One of the reasons for the AR-15's widespread popularity and usage is its modularity. The AR-15 can initially be broken down into two main components, an upper receiver and a lower receiver. The upper receiver includes two lugs, each of which includes an aperture formed therethrough. The lower receiver includes cutouts for receiving the lugs of the upper receiver and appropriate apertures to be aligned with the upper receiver lug apertures.

When the upper receiver and the lower receiver are appropriately aligned, a pivot pin is slidably secured within the aligned apertures proximate the front of the lower receiver and a take-down pin is slidably secured within the aligned apertures proximate the rear of the lower receiver to secure the upper receiver to the lower receiver. Once initially installed within the appropriate apertures in the lower receiver, the pivot pin and the take-down pin each slide between a locked and an unlocked position, but remain attached or coupled to the lower receiver via interaction of a spring biased blocking element and a primary channel and primary recesses formed in the pivot pin and the take-down pin.

Because the upper and lower receivers are secured with slidably movable pins, the upper receiver can optionally be pivoted on the lower receiver or removed from the lower receiver. This allows a user to access various components of the firearm more easily for cleaning and lubrication. Additionally, alternate upper receivers can be used with a single lower receiver or vice versa.

As illustrated in FIGS. 1-5, when the upper receiver 3 and the lower receiver 6 are appropriately aligned, the upper pivot pin lug aperture 4 is aligned between the lower pivot pin lug apertures 7 such that the pivot pin 9 can be slidably moved to the locking position and the upper take-down lug aperture 5 is aligned between the lower take-down lug apertures 8 such that the take-down pin 10 can be slidably moved to the locking position. Generally, attaching the upper receiver 3 to the lower receiver 6 is accomplished by first coupling or attaching, via the pivot pin 9, the upper receiver 3 to the lower receiver 6. Then, the upper receiver 3 is pivoted, via interaction between the pivot pin 9 and the upper pivot pin lug aperture 4, until the upper take-down lug aperture 5 is appropriately aligned between the lower take-down lug apertures 8 and the take-down pin 10 is slidably moved to the locking position.

The firearm 2 and, more particularly, the lower receiver 6, includes a pushbutton magazine release button 11 found on one side of the firearm 2. Ofttimes, as further illustrated in FIGS. 3-5, the magazine release button 11 is at least partially protected by one or more ridges that reduce the chances of inadvertent activation.

The magazine release button 11 typically includes an internal, aperture 12 that extends through the entire magazine release button 11. The magazine release mechanism typically includes a magazine release button 11 that is coupled to a magazine release 20, which includes a magazine engagement projection 23 that releasably engages a portion of a magazine, when fully inserted within the magazine well of the firearm 2.

The magazine release 20 includes a magazine release connection shaft 21 that extends from one side of the magazine release. The magazine release connection shaft 21 includes a threaded portion 22 that can be threaded late engaged with the aperture 12 of the magazine release button 11.

A magazine release spring 15 typically provides spring biasing to the magazine release button 11, when installed in the firearm 2.

When the magazine release button 11 is depressed, the magazine release 20 is urged outside of the magazine well, such that the magazine engagement projection 23 is withdrawn from an inserted magazine, allowing the magazine to be removed from the magazine well.

It should be appreciated that a more detailed explanation of the components of the upper receiver 3, lower receiver 6, pivot pin 9, take-down pin 10, and magazine release button 11, instructions regarding how to attach and remove the upper receiver 3 and the lower receiver 6, methods for installing the pivot pin 9 and/or the take-down pin 10 within the lower receiver 6, and certain other items and/or techniques necessary for the implementation and/or operation of the various components of the AR-15 platform are not provided herein because such components are commercially available and/or such background information will be known to one of ordinary skill in the art. Therefore, it is believed that the level of description provided herein is sufficient to enable one of ordinary skill in the art to understand and practice the method as described.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE DISCLOSURE

Known magazine release button arrangements allow for unobstructed manipulation of the magazine release button, so that magazines can be easily and readily exchanged.

In various exemplary, non-limiting embodiments, the present disclosure comprises a magazine release button obstruction or block that blocks or otherwise obstructs at least a portion of the magazine release button, such that the magazine release button cannot be manipulated to allow a magazine to be removed (or potentially inserted) into the magazine well. In certain exemplary embodiments, the magazine release button obstruction or block is engaged when the upper receiver and the lower receiver of the firearm are attached or coupled together in a firing or operable condition.

In certain exemplary, non-limiting embodiments, the present disclosure comprises a blocking element that is slidably positioned within a blocking element channel formed in a portion of a lower receiver of a firearm. The blocking element is slidable between an engaged position and a disengaged position. In the engaged position, at least a portion of the blocking element keeps the magazine release button from being depressed a sufficient distance to urge the magazine engagement projection a sufficient distance to disengage from an inserted magazine and allow the inserted magazine to be removed from the magazine well. In the disengaged position, the blocking element is retracted such that the magazine release button may be depressed a sufficient distance to urge the magazine engagement projection a sufficient distance to disengage from an inserted magazine and allow the inserted magazine to be removed from the magazine well.

In various exemplary, nonlimiting embodiments, the magazine release block of the present disclosure comprises a blocking element; and a lower receiver of a firearm, wherein the lower receiver comprises a blocking element channel extending between an upper surface of the lower receiver and a magazine release button receiving cavity, wherein the blocking element is positioned within the blocking element channel, and wherein the blocking element is movable between a disengaged position wherein the blocking element does not inhibit movement of a magazine release button and an engaged position wherein at least a portion of the blocking element inhibit movement of a magazine release button, and wherein when an upper receiver of the firearm is operably positioned atop the lower receiver a surface of the upper receiver urges the blocking element to the engaged position.

In various exemplary, nonlimiting embodiments, the magazine release block of the present disclosure comprises a blocking element; and a blocking element channel extending between an upper surface of the lower receiver and a magazine release receiving cavity, wherein the blocking element is positioned within the blocking element channel, and wherein the blocking element is movable between a disengaged position wherein the blocking element does not inhibit movement of a magazine release and an engaged position wherein at least a portion of the blocking element inhibits movement of the magazine release, and wherein when an upper receiver of the firearm is operably positioned atop the lower receiver a surface of the upper receiver urges the blocking element to the engaged position.

In various exemplary, nonlimiting embodiments, the magazine release block of the present disclosure comprises an elongate blocking element extending from a portion of an upper receiver of the firearm; wherein if the upper receiver of the firearm is operably positioned atop a lower receiver of the firearm, at least a portion of the elongate blocking element extends so as to inhibit movement of a magazine release button of the lower receiver.

Accordingly, the present disclosure separately and optionally provides a magazine release block that is capable of preventing an inserted magazine from being released from a firearm.

The present disclosure separately and optionally provides a magazine release block that is capable of preventing an inserted magazine from being released from a firearm magazine well, so long as the upper receiver of the firearm is operably attached or coupled to the lower receiver of the firearm.

The present disclosure separately and optionally provides a magazine release block that is capable of preventing a magazine from being operably inserted within a firearm magazine well, so long as the upper receiver of the firearm is operably attached or coupled to the lower receiver of the firearm.

The present disclosure separately and optionally provides a magazine release block that may be retrofitted to a firearm.

The present disclosure separately and optionally provides a magazine release block that will allow the magazine release to function freely if the upper receiver is at least partially separated from the lower receiver.

The present disclosure separately and optionally provides a magazine release block that provides a blocking element that may be at least partially positioned behind the magazine release button to block or otherwise inhibit movement of the magazine release button, without modification to the magazine release button.

The present disclosure separately and optionally provides a magazine release block that provides a blocking element that may be at least partially positioned within a hole, recess, or other portion of a modified magazine release button to block or otherwise inhibit movement of the magazine release button.

The present disclosure separately and optionally provides a magazine release block that provides a blocking element that may be at least partially positioned within at least a portion of a mating cut or recess behind the magazine release button.

The present disclosure separately and optionally provides a magazine release block that provides a blocking element that may be at least partially positioned behind the magazine release to block or otherwise inhibit movement of the magazine release, without modification to the magazine release.

The present disclosure separately and optionally provides a magazine release block that provides a blocking element that may be at least partially positioned within at least a portion of the magazine release.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures. While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments of the disclosure discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the present disclosure are discussed herein; however, it is to be understood that the disclosed embodiments are merely exemplary of the disclosure that may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the present disclosure will be described in detail, with reference to the following figures, wherein like reference numerals refer to like parts throughout the several views, and wherein.

DETAILED DESCRIPTION OF THE DISCLOSURE

Figure 1:
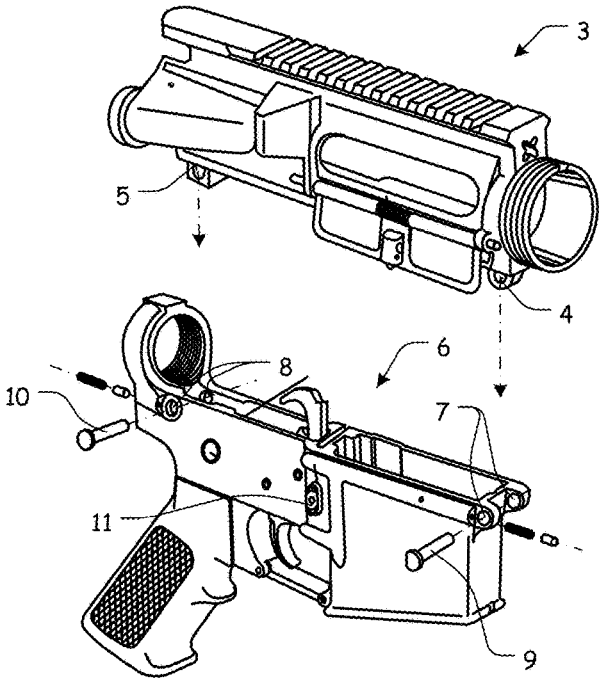
FIG. 1 PRIOR ART
FIG. 1 illustrates a perspective view of certain components of an AR-15 style upper and lower receiver.

For simplicity and clarification, the design factors and operating principles of the magazine release block according to the present disclosure are explained with reference to various exemplary embodiments of a magazine release block according to the present disclosure. The basic explanation of the design factors and operating principles of the magazine release block is applicable for the understanding, design, and operation of the magazine release block of the present disclosure. It should be appreciated that the magazine release block can be adapted to many applications where a magazine release block or strap can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the elements such terms describe. Thus, these terms are not necessarily intended to indicate temporal or other prioritization of such elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "magazine release block", "magazine release button", and "firearm" are used for basic explanation and understanding of the operation of the systems, methods, and apparatuses of the present disclosure. Therefore, the terms "magazine release block", "magazine release button", and "firearm" are not to be construed as limiting the systems, methods, and apparatuses of the present disclosure.

For simplicity and clarification, the magazine release block of the present disclosure will be described as being used in conjunction with a firearm, such as an AR-15 or M4 style rifle or carbine. However, it should be appreciated that these are merely exemplary embodiments of the magazine release block and are not to be construed as limiting the present disclosure. Thus, the magazine release block of the present disclosure may be utilized in conjunction with any appropriate firearm, object, or device.

Figure 2:
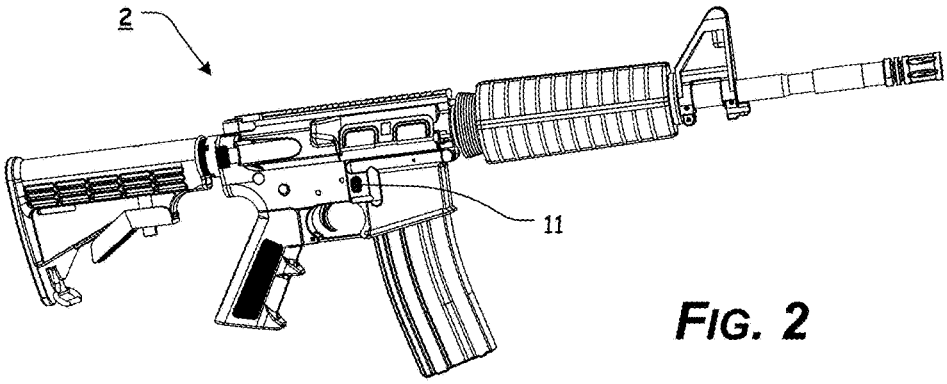
FIG. 2 PRIOR ART
FIG. 2 illustrates a perspective view of certain components of an AR-15 style firearm.
Figure 3:
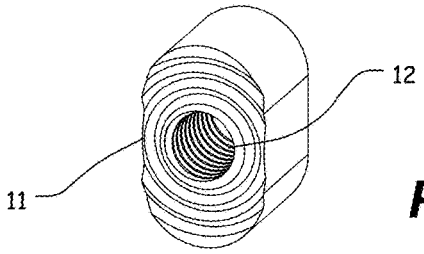
FIG. 3 PRIOR ART
FIG. 3 illustrates a more detailed view of a known magazine release button for an AR-15 style firearm.
Figure 4:
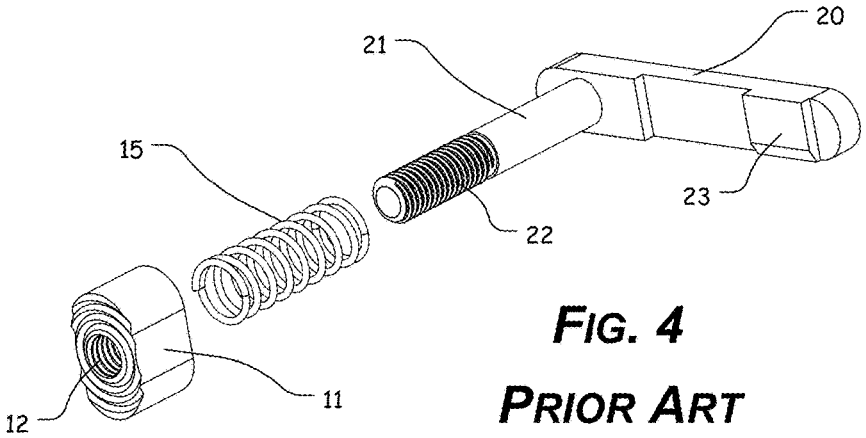
FIG. 4 PRIOR ART
FIG. 4 illustrates a more detailed, exploded view of the components of the known magazine release and magazine release button.
Figure 5:
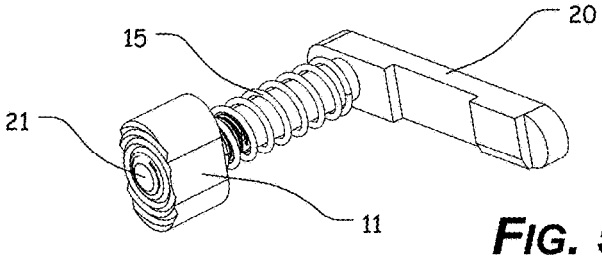
FIG. 5 PRIOR ART
FIG. 5 illustrates a more detailed, assembled view of the components of the known magazine release and magazine release button.

Turning now to the drawing Figs., as discussed above, FIGS. 1-2 illustrate certain elements and/or aspects of a known AR-15 or M4 style rifle or carbine, while FIGS. 3-5 illustrate certain elements and/or aspects of a known magazine release button assembly of a known AR-15 or M4 style rifle or carbine.

FIGS. 6-32 illustrate certain elements and/or aspects of an exemplary embodiment of the magazine release block 100, according to the present disclosure. In illustrative, non-limiting embodiment(s) of the present disclosure, as illustrated in FIGS. 6-20, the exemplary embodiments of the magazine release block 100 are utilized in conjunction with a firearm 102. As illustrated, the firearm 102 most closely resembles an AR-15 or M4 style platform. However, it should be understood and appreciated that the firearm 102 is not so limited and the magazine release block 100 of the present disclosure can be utilized in connection with any AR-15 or M4 style platform or any other firearm or platform, such as, for example, a FAL or SCAR style firearm, or any other firearm or platform having a pivotably or hingedly connected upper and lower element or component.

With that understanding, the firearm 102, as illustrated in FIGS. 6-20, comprises an upper receiver 103 and a lower receiver 106. The upper receiver 103 and the lower receiver 106 comprise at least some of an upper pivot pin lug aperture 104 (not shown), an upper take-down lug aperture 105, lower pivot pin lug apertures 107, lower take-down lug apertures 108, a pivot pin 109, a take-down pin 110, a magazine release button 111 that travels back and forth within at least a portion of a magazine release button receiving cavity 118. The magazine release button 111 includes at least some of an internal aperture 112, a magazine release spring 115, a magazine release 120, a magazine release connection shaft 121, a threaded portion 122, and a magazine engagement projection 123.

It should be appreciated that each of these elements (as well as other, similarly named elements of the upper receiver 103 and the lower receiver 106) correspond to and operate similarly to similarly named elements, as described herein with reference to the elements of the upper receiver 103 and a lower receiver 106 of FIGS. 1-5. Thus, it should be appreciated that the upper receiver 103 and a lower receiver 106 may incorporate one or any of the features or elements of the upper receiver 103 and a lower receiver 106 of FIGS. 1-5.

However, as shown in FIGS. 6-32, in illustrative, non-limiting embodiment(s) of the present disclosure, the lower receiver 106 and/or the magazine release block 100 comprise at least some of a magazine release button obstruction or block, such as, for example, a blocking element 130 positioned within a blocking element channel 150 formed in a lower receiver 106 of a firearm 102. In various exemplary, non-limiting embodiments, at least a portion of the blocking element 130 (or other magazine release button obstruction or block) blocks or otherwise obstructs at least a portion of the magazine release button 111, such that the magazine release button 111 cannot be manipulated to allow a magazine to be removed (or potentially inserted) into the magazine well 116. In certain exemplary embodiments, the blocking element 130 is engaged when the upper receiver 103 and the lower receiver 106 of the firearm 102 are attached or coupled together in an operable configuration, i.e., a configuration that allows the firearm 102 to be fired.

In certain exemplary, non-limiting embodiments, the magazine release block 100 comprises a blocking element 130 that is slidably positioned within a blocking element channel 150 formed in a portion of the lower receiver 106 of a firearm 102. The blocking element 130 is slidable between an engaged position (as illustrated most clearly in FIGS. 6, 8-11, and 14-19) and a disengaged position (as illustrated most clearly in FIGS. 7 and 12-13).

The blocking element 130 comprises an elongate portion of material extending along a longitudinal axis, $A_L$, from a top surface 131 to a bottom surface 133. In various exemplary embodiments, the blocking element 130 is a substantially cylindrical detent pin having a substantially circular cross-section. However, in various exemplary, nonlimiting embodiments, the blocking element 130 may optionally have a substantially circular, oval, oblong, rectangular, square, triangular, or other profile, or may comprise a pin, a plate, a bar, or other shape. It should be appreciated that the blocking element channel 150 comprises a shape that allows the blocking element 130 to move within at least a portion of the blocking element 130 to function as outlined herein.

In various exemplary embodiments, a blocking element shoulder 135 extends from a portion of the blocking element 130, between the top surface 131 and the bottom surface 133. An upper portion 137 is defined between the blocking element shoulder 135 and the top surface 131 and a lower portion 138 is defined between the blocking element shoulder 135 and the bottom surface 133. In certain exemplary embodiments, the upper portion 137 and the lower portion 138 have a substantially similar outer diameter, D1. Alternatively, the upper portion 137 of the lower portion 138 may have different outer diameters. The blocking element shoulder 135 extends from a portion of the blocking element 130 and has an outer diameter, D2, which is greater than the outer diameter D1 of the upper portion 137 and/or the lower portion 138.

In certain exemplary embodiments, an upper chamfer 132 may be provided as a transition between an outer surface of the upper portion 137 and the top surface 131 and a lower chamfer 134 may be provided as a transition between an outer surface of the lower portion 138 and the bottom surface 133. The upper chamfer 132 and/or lower chamfer 134, if included, may provide a radiused, rounded, or arcuate transition between the upper portion 137 and the top surface 131 and the lower portion 138 of the bottom surface 133, respectively.

A blocking element channel 150 is formed in a portion of the lower receiver 106. In various exemplary embodiments, the blocking element channel 150 is formed so as to extend along a longitudinal axis, between an upper surface 114 of the lower receiver 106 and an internal, magazine release button receiving cavity 118. In various exemplary embodiments, the blocking element channel 150 includes a threaded pin channel portion 155 that extends from the upper surface 114 of the lower receiver 106 to a first pin channel portion 151. If included, the threaded pin channel portion 155 is internally threaded so as to be able to interact with external threads of the set screw 140.

The first pin channel portion 151 optionally extends from the upper surface 114 of the lower receiver 106 or from the threaded pin channel portion 155 to a pin channel shoulder 153. In various exemplary embodiments, a surface of the pin channel shoulder 153 extends substantially perpendicular to a surface of the first pin channel portion 151. Alternatively, a surface of the pin channel shoulder 153 may extend at an angle that is equal to, greater than, or less than 90° relative to a surface of the first pin channel portion 151 and/or the longitudinal axis of the first pin channel portion 151.

A second pin channel portion 152 extends from the pin channel shoulder 153 to the magazine release button receiving cavity 118.

The blocking element channel 150 is formed such that at least portions of the blocking element 130 can be received within appropriate portions of the blocking element channel 150. For example, the lower portion 138 of the blocking element 130 is formed so as to be slidable within the second pin channel portion 152. The blocking element shoulder 135 is formed so as to be slidable within the first pin channel portion 151.

A blocking element biasing spring 157 is formed so as to allow the lower portion 138 of the blocking element 130 to be received within the detent biasing spring. Furthermore, the detent biasing spring is formed so as to be received within the first pin channel portion 151. The blocking element shoulder 135 is formed so as to provide a stop or surface against which the blocking element biasing spring 157 is able to interact.

In various exemplary embodiments, set screw 140 includes at least some external threads that are able to threadedly interact with the internal threads of the threaded pin channel portion 155.

In various exemplary embodiments, the set screw 140 includes a set screw aperture 142 formed through the set screw 140. The set screw aperture 142 is formed so as to allow the upper portion 137 of the blocking element 130 to be received within the set screw aperture 142. In various exemplary embodiments, the set screw aperture 142 may comprise an internal hex socket aperture that is formed through the set screw 140. However, it should be appreciated that all or portions of the set screw aperture 142 may take on any desired overall shape.

While the various exemplary embodiments of the magazine release block 100 are illustrated as including a set screw 140 having external threads that interact with internal threads of the threaded pin channel portion 155, the set screw 140 may be replaced by a non-threaded or partially threaded element that is frictionally, adhesively, or otherwise held in position to provide an aperture through which at least a portion of the blocking element 130 is able to protrude.

During installation of the blocking element 130 within the lower receiver 106, the lower portion 138 of the blocking element 130 is slidably urged through the interior of the blocking element biasing spring 157, such that a first end 158 of the blocking element biasing spring 157 contacts a surface of the blocking element shoulder 135. The blocking element 130 is positioned within the blocking element channel 150 such that at least a portion of the lower portion 138 of the blocking element 130 is received within the second pin channel portion 152. When the portion of the lower portion 138 of the blocking element 130 is received within the second pin portion, a second end 159 of the blocking element biasing spring 157 contacts the pin channel shoulder 153. In this manner, the blocking element biasing spring 157 is captured about a portion of the lower portion 138 of the blocking element 130, between the pin channel shoulder 153 and the blocking element shoulder 135. Thus, the blocking element 130 is spring biased within the blocking element channel 150.

Once the blocking element 130 and blocking element biasing spring 157 are appropriately positioned within the blocking element channel 150, a portion of the upper portion 137 of the blocking element 130 is received through the set screw aperture 142 and the set screw 140 is attached or coupled within the threaded pin channel portion 155 via interaction between the external threads of the set screw 140 and the internal threads of the threaded pin channel portion 155. In various exemplary embodiments, the set screw 140 is threaded the attached or coupled to the lower receiver 106, such that an upper portion 137 of the set screw 140 is coplanar with or below the upper surface 114 of the lower receiver 106. In this manner, the set screw 140 does not protrude above the upper surface 114 of the lower receiver 106 to hinder operable attachment of the upper receiver 103 and the lower receiver 106 of the firearm 102.

As also described, the set screw 140 may be appropriately positioned by frictional, adhesive, or welding attachment.

Figure 6:
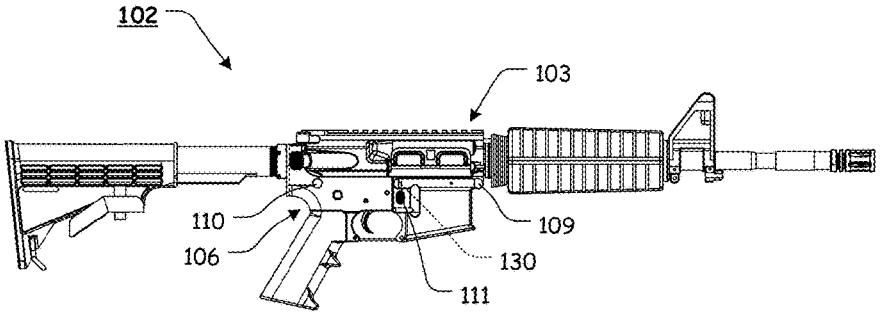
FIG. 6 illustrates a side view showing certain exemplary components of an exemplary embodiment of a magazine release block, wherein the upper receiver and the lower receiver are in an operable position and the blocking element is in an engaged position, according to the present disclosure.
Figure 7:
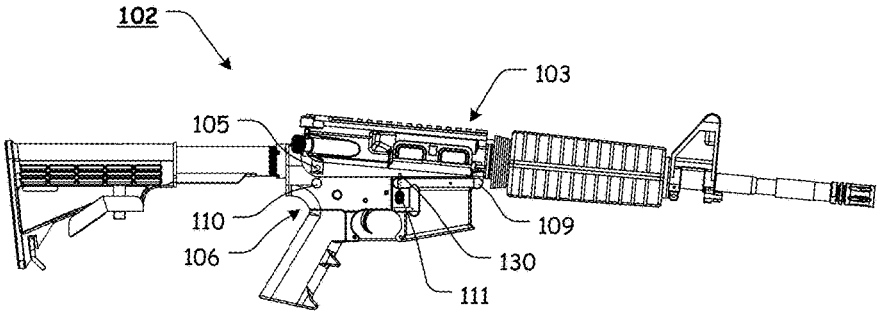
FIG. 7 illustrates a side view showing certain exemplary components of an exemplary embodiment of a magazine release block, wherein the upper receiver and the lower receiver are in an inoperable position and the blocking element is in a disengaged position, according to the present disclosure.
Figure 8:
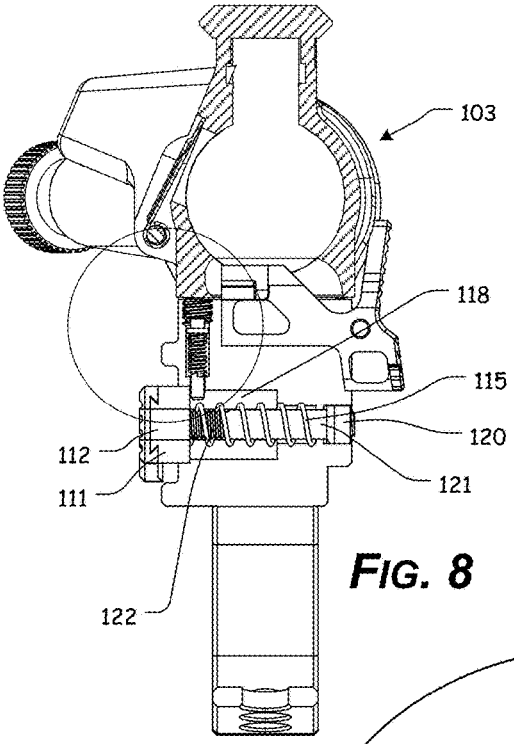
FIG. 8 illustrates a front, cross-sectional view showing the components of an exemplary embodiment of a magazine release block, wherein the blocking element is in an engaged position, according to the present disclosure.
Figure 9:
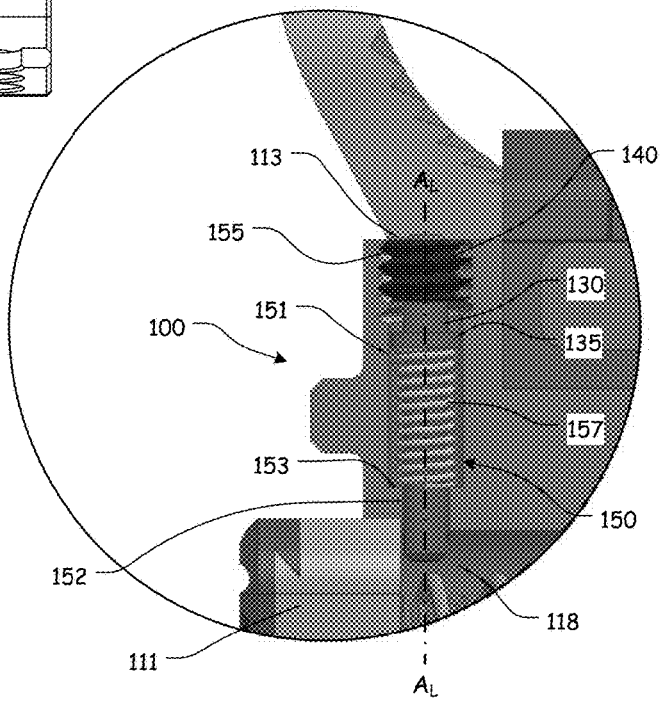
FIG. 9 illustrates a more detailed view of the front, cross-sectional view of FIG. 8, showing the components of an exemplary embodiment of a magazine release block, according to the present disclosure.
Figure 10:
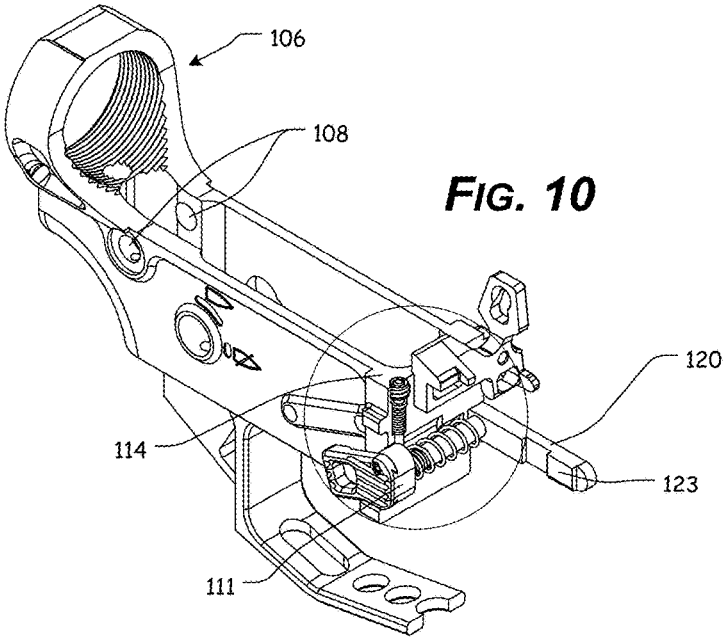
FIG. 10 illustrates a front, perspective, cross-sectional view showing the components of an exemplary embodiment of a magazine release block, wherein the blocking element is in an engaged position, according to the present disclosure.
Figure 11:
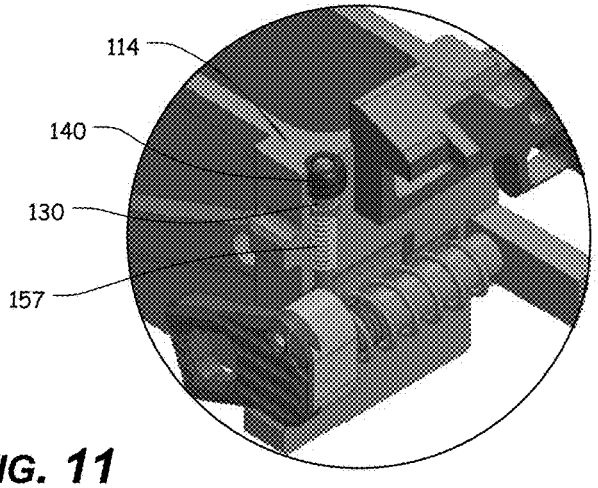
FIG. 11 illustrates a more detailed view of the front, cross-sectional view of FIG. 10, showing the components of an exemplary embodiment of a magazine release block, according to the present disclosure.
Figure 12:
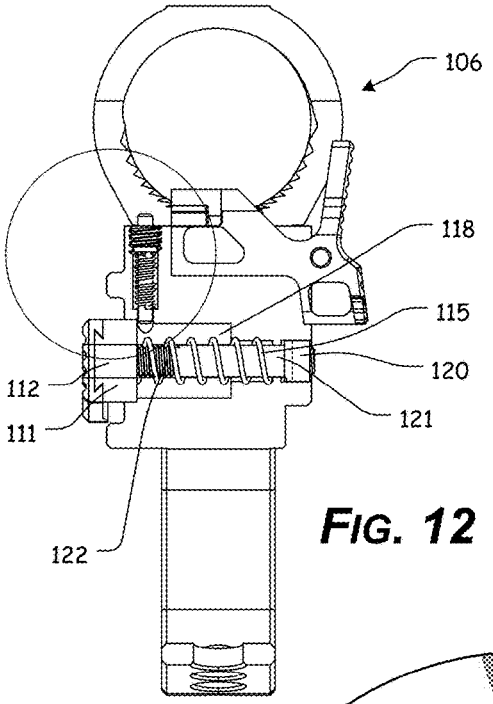
FIG. 12 illustrates a front, cross-sectional view showing the components of an exemplary embodiment of a magazine release block, wherein the blocking element is in a disengaged position, according to the present disclosure.
Figure 13:
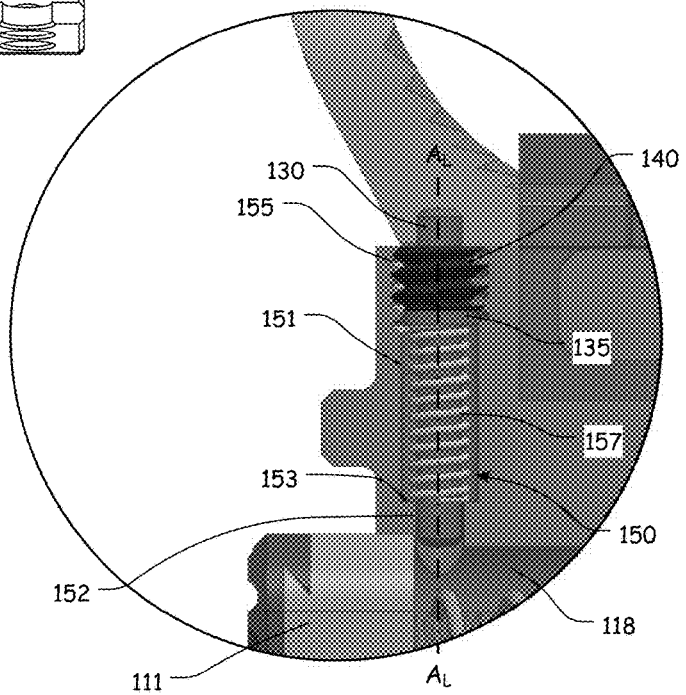
FIG. 13 illustrates a more detailed view of the front, cross-sectional view of FIG. 12, showing the components of an exemplary embodiment of a magazine release block, according to the present disclosure.
Figure 14:
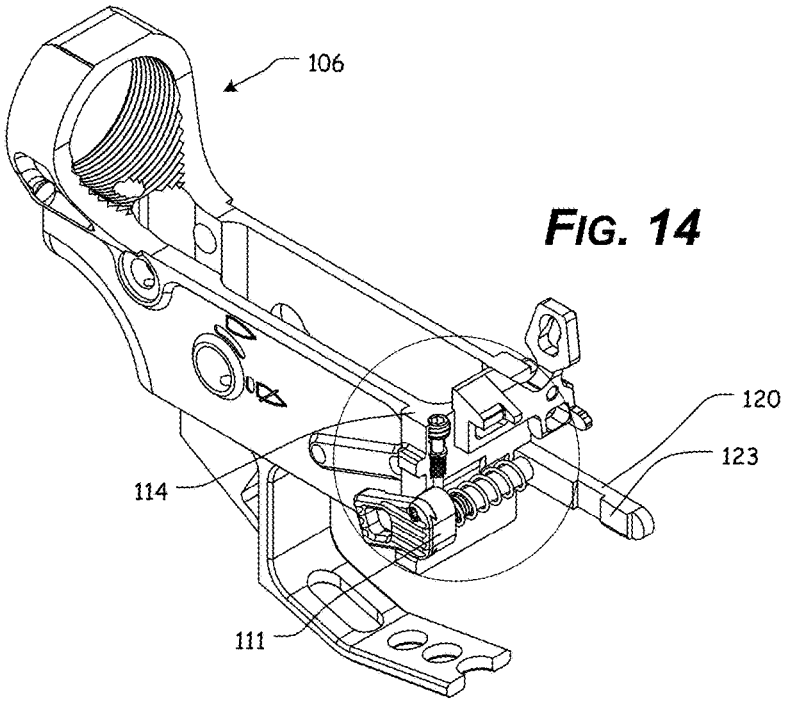
FIG. 14 illustrates a front, perspective, cross-sectional view showing the components of an exemplary embodiment of a magazine release block, wherein the blocking element is depressed below the upper surface of the lower receiver and in an engaged position, according to the present disclosure.
Figure 15:
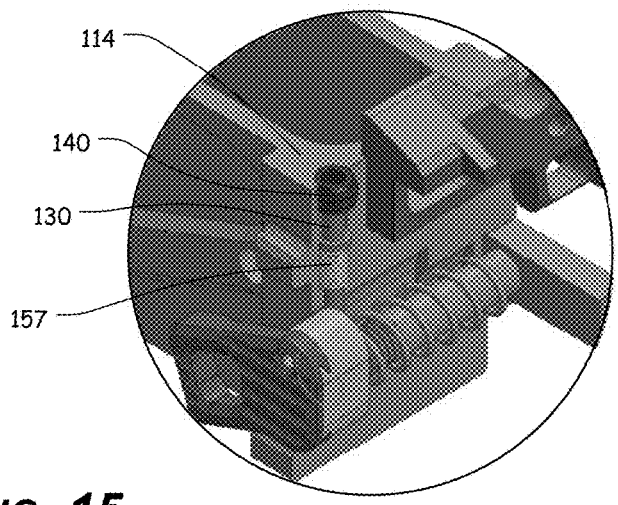
FIG. 15 illustrates a more detailed view of the front, cross-sectional view of FIG. 14, showing the components of an exemplary embodiment of a magazine release block, according to the present disclosure.
Figure 16:
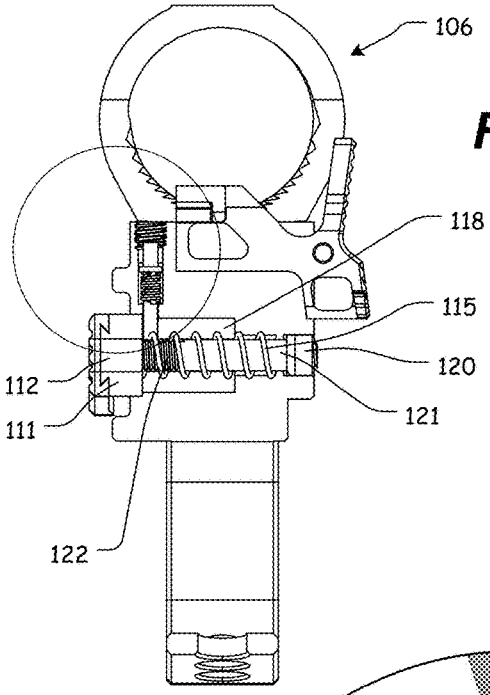
FIG. 16 illustrates a front, cross-sectional view showing the components of an exemplary embodiment of a magazine release block, wherein the blocking element is in an engaged position, according to the present disclosure.
Figure 17:
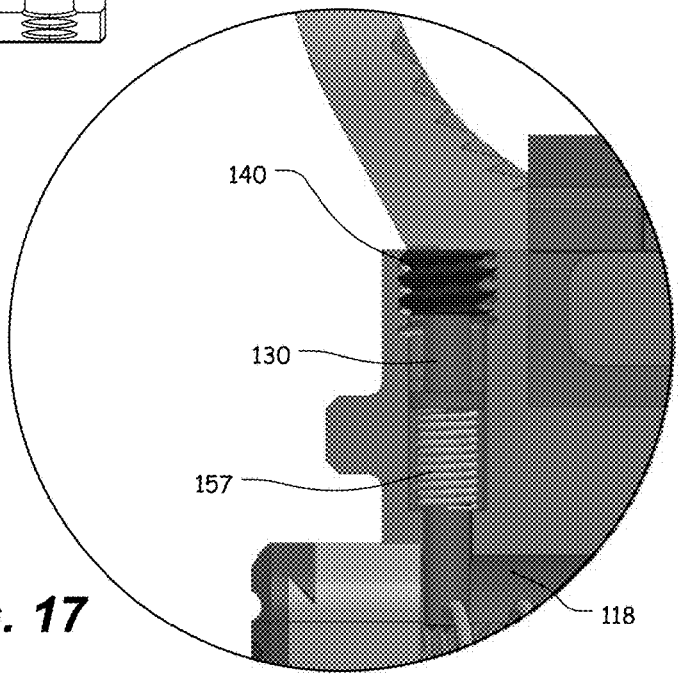
FIG. 17 illustrates a more detailed view of the front, cross-sectional view of FIG. 16, showing the components of an exemplary embodiment of a magazine release block, according to the present disclosure.
Figure 18:
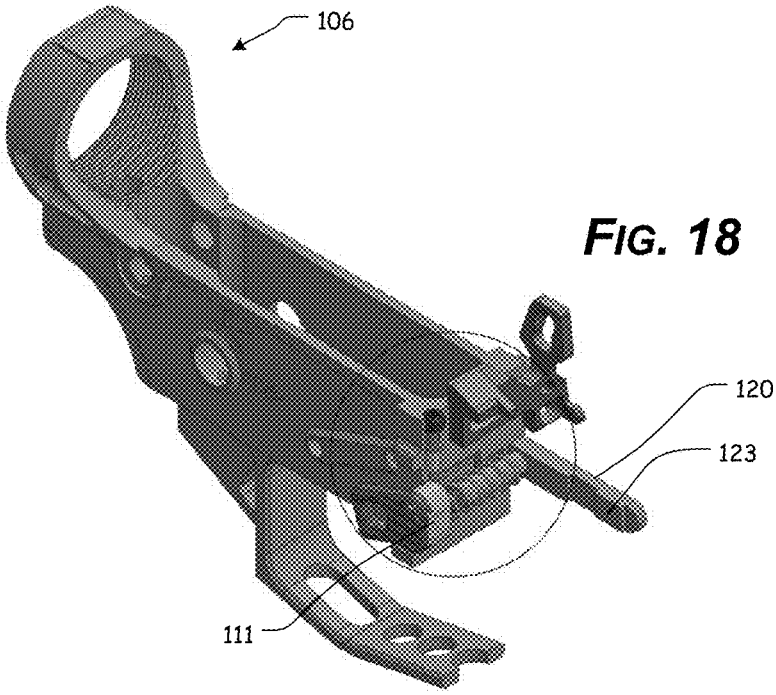
FIG. 18 illustrates a front, perspective, cross-sectional view showing the components of an exemplary embodiment of a magazine release block, wherein the blocking element is in an engaged position, according to the present disclosure.
Figure 19:
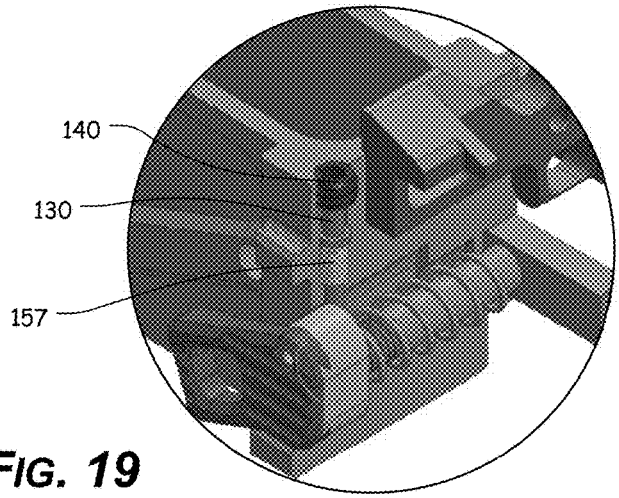
FIG. 19 illustrates a more detailed view of the front, cross-sectional view of FIG. 18, showing the components of an exemplary embodiment of a magazine release block, according to the present disclosure.
Figure 20:
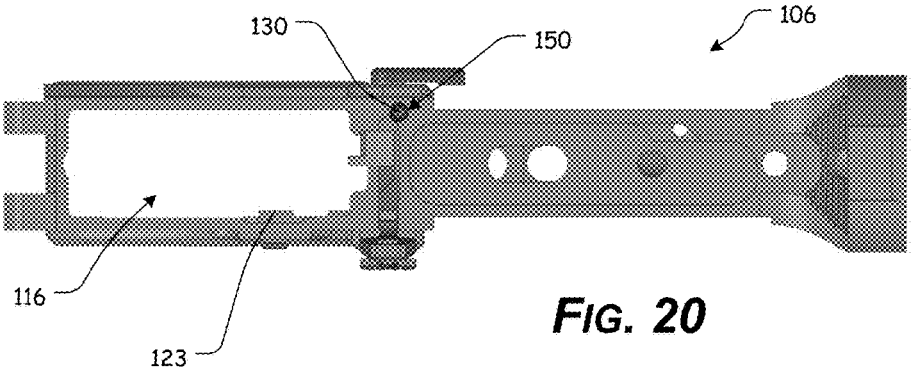
FIG. 20 illustrates a top view showing certain of the components of an exemplary embodiment of a magazine release block within an exemplary lower receiver, according to the present disclosure.
Figure 21:
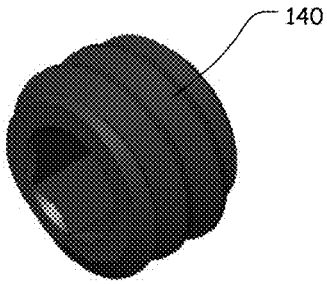
FIG. 21 illustrates a perspective view of an exemplary embodiment of a set screw, according to the present disclosure.
Figure 22:
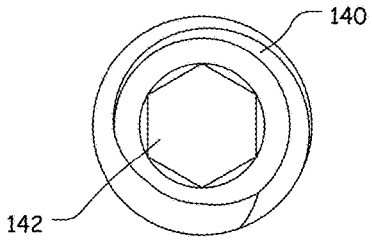
FIG. 22 illustrates a top view of an exemplary embodiment of a set screw, according to the present disclosure.
Figure 23:
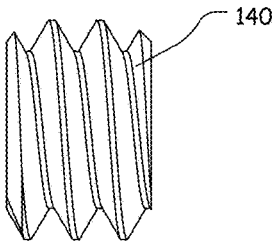
FIG. 23 illustrates a side view of an exemplary embodiment of a set screw, according to the present disclosure.
Figure 24:
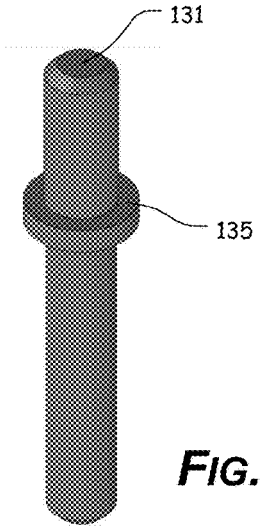
FIG. 24 illustrates a top, perspective view of an exemplary embodiment of a blocking element, according to the present disclosure.
Figure 25:
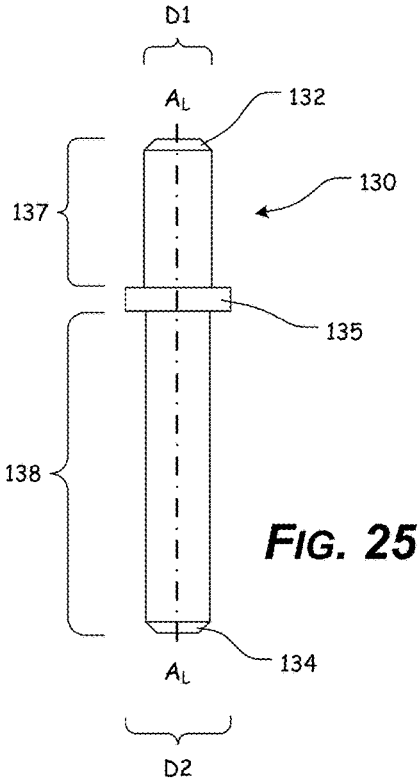
FIG. 25 illustrates a side view of an exemplary embodiment of a blocking element, according to the present disclosure.
Figure 26:
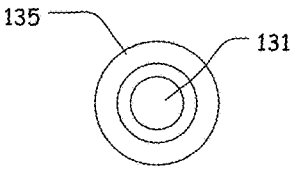
FIG. 26 illustrates a top view of an exemplary embodiment of a blocking element, according to the present disclosure.
Figure 27:
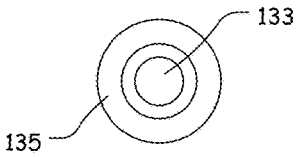
FIG. 27 illustrates a bottom view of an exemplary embodiment of a blocking element, according to the present disclosure.
Figure 28:
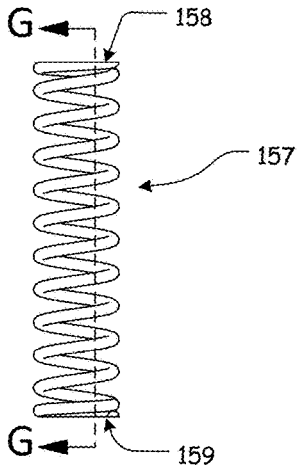
FIG. 28 illustrates a side view of an exemplary embodiment of a blocking element biasing spring, wherein the blocking element biasing spring is in an expanded position, according to the present disclosure.
Figure 29:
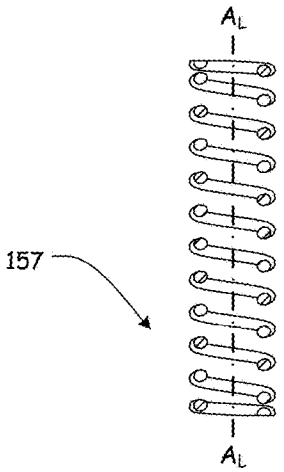
FIG. 29 illustrates a side, cross-sectional view of an exemplary embodiment of a blocking element biasing spring, taken along line G-G of FIG. 28, wherein the blocking element biasing spring is in an expanded position, according to the present disclosure.
Figure 30:
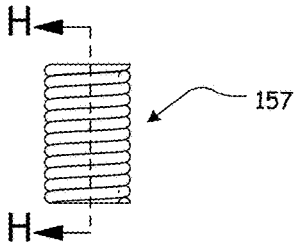
FIG. 30 illustrates a side view of an exemplary embodiment of a blocking element biasing spring, wherein the blocking element biasing spring is in a compressed position, according to the present disclosure.
Figure 31:
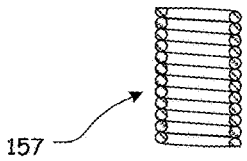
FIG. 31 illustrates a side, cross-sectional view of an exemplary embodiment of a blocking element biasing spring, taken along line H-H of FIG. 30, wherein the blocking element biasing spring is in a compressed position, according to the present disclosure.
Figure 32:
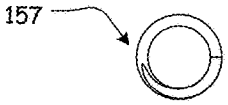
FIG. 32 illustrates a top view of an exemplary embodiment of a blocking element biasing spring, according to the present disclosure.

Once installed, the blocking element 130 is repeatably slidable between an engaged position (as illustrated most clearly in FIGS. 6, 8-11, and 14-19) and a disengaged position (as illustrated most clearly in FIGS. 7 and 12-13). In the disengaged position, the spring bias of the blocking element biasing spring 157 urges the blocking element 130 such that at least a portion of the upper portion 137 of the blocking element 130 extends above the surface of the set screw 140 and above the upper surface 114 of the lower receiver 106. At the same time, the lower portion 138 of the blocking element 130 is withdrawn from the magazine release button receiving cavity 118. In this manner, the magazine release button 111 remains free to be manipulated such that a magazine can be inserted or withdrawn from the magazine well 116 of the firearm 102.

In the engaged position, at least a portion of the lower portion 138 of the blocking element 130 is urged within the magazine release button receiving cavity 118, so as to block or obstruct movement of the magazine release button 111. Thus, in the engaged position, at least a portion of the lower portion 138 of the blocking element 130 blocks or obstructs movement of the magazine release button 111 such that the magazine release button 111 cannot be manipulated to allow a magazine to be removed (or potentially inserted) into the magazine well 116.

In various exemplary embodiments, the blocking element 130 is positioned such that when the upper receiver 103 is operably attached or coupled to the lower receiver 106 (as is required in order to be able to fire the firearm 102) a lower surface 113 of the upper receiver 103 makes contact with the top surface 131 of the blocking element 130 and urges the blocking element 130 to the engaged position. Thus, while the upper receiver 103 is operably attached or coupled to the lower receiver 106, the blocking element 130 remains in the engaged position. When in the engaged position, as illustrated in FIG. 6, at least a portion of the blocking element 130 keeps the magazine release button 111 from being depressed a sufficient distance to urge the magazine engagement projection 123 a sufficient distance to disengage from an inserted magazine and allow the inserted magazine to be released or removed from the magazine well 116 or allow a magazine to be operably inserted within the magazine well 116 of the firearm 102.

In order to utilize the magazine release button 111 to insert a magazine into the magazine well 116 or remove an inserted magazine from the magazine well 116, the blocking element 130 must be in the disengaged position. In the disengaged position, the blocking element 130 is retracted such that the magazine release button 111 may be depressed a sufficient distance to urge the magazine engagement projection 23 a sufficient distance to disengage from an inserted magazine and allow the inserted magazine to be released or removed from the magazine well 116.

In order to be in the disengaged position, the upper receiver 103 must at least be partially rotated away from, separated from, or removed from the lower receiver 106, as illustrated in FIG. 7. When the upper receiver 103 is sufficiently rotated away from, separated from, or removed from the lower receiver 106 for the blocking element 130 to be urged into the disengaged position, the firearm 102 is in an inoperable state and cannot be fired.

Thus, it should be appreciated that the blocking element 130 may be urged into the disengaged position when the upper receiver 103 and the lower receiver 106 are at least partially rotated away from one another, separated from one another, or completely removed from one another.

In various exemplary embodiments, various components of the magazine release block 100 are substantially rigid and are formed of steel. Alternate materials of construction of the various components of the magazine release block 100 may include one or more of the following: stainless steel, aluminum, titanium, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form the various components of the magazine release block 100 is a design choice based on the desired appearance and functionality of the magazine release block 100.

It should be appreciated that certain elements of the magazine release block 100 may be formed as an integral unit. Alternatively, suitable materials can be used and sections or elements made independently and attached or coupled together, such as by adhesives, welding, screws, rivets, pins, or other fasteners, to form the various elements of the magazine release block 100.

It should also be understood that the overall size and shape of the magazine release block 100 and the various portions thereof is a design choice based upon the desired strength, functionality, and/or appearance of the magazine release block 100.

Figure 33:
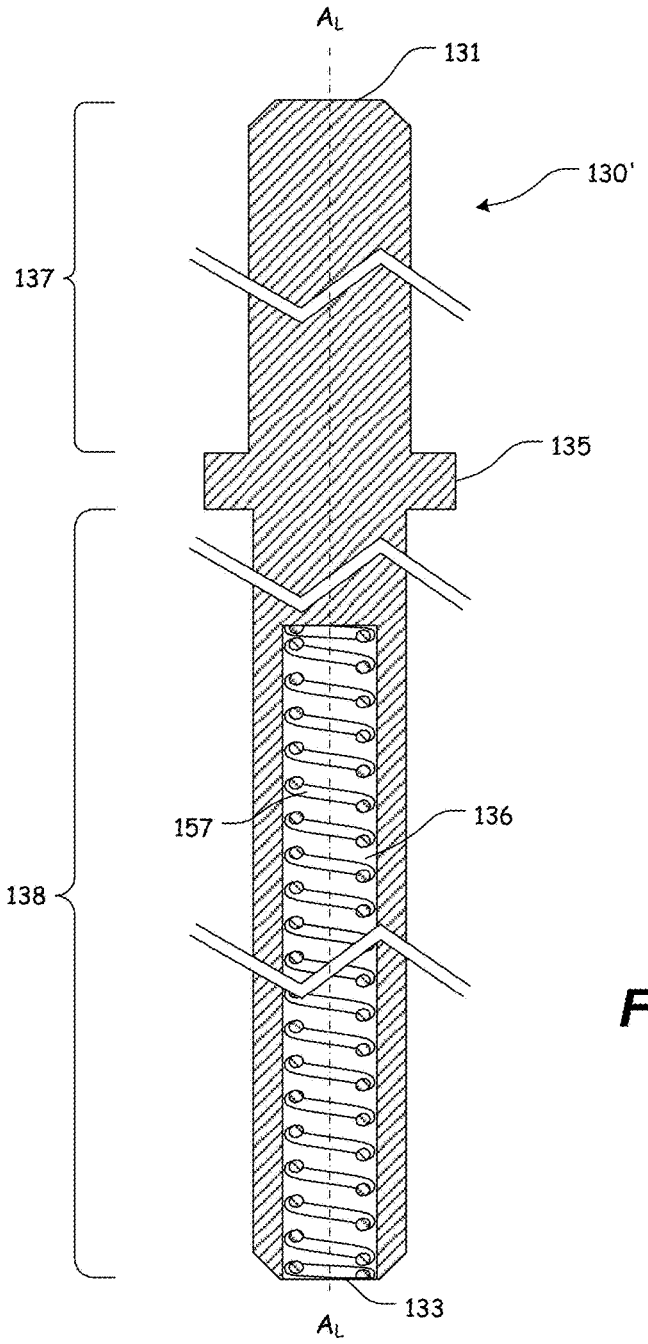
FIG. 33 illustrates a s cross-sectional view of an exemplary embodiment of a blocking element, according to the present disclosure.

FIG. 33 illustrates a s cross-sectional view of an exemplary embodiment of a blocking element 130', according to the present disclosure. As illustrated, the blocking element 130' is similar to the blocking element 130. However, the blocking element 130' comprises a borehole or recess 136, which extends from the bottom surface 133. The recess 136 is formed so as to allow the blocking element biasing spring 157 to be at least partially received within the recess 136. Thus, each be appreciated that the spring biasing element 157 may be formed so as to be positioned at least partially around a portion of the lower portion 138 of the blocking element 130 or within the recess 136 of the blocking element 130'.

Figure 34:
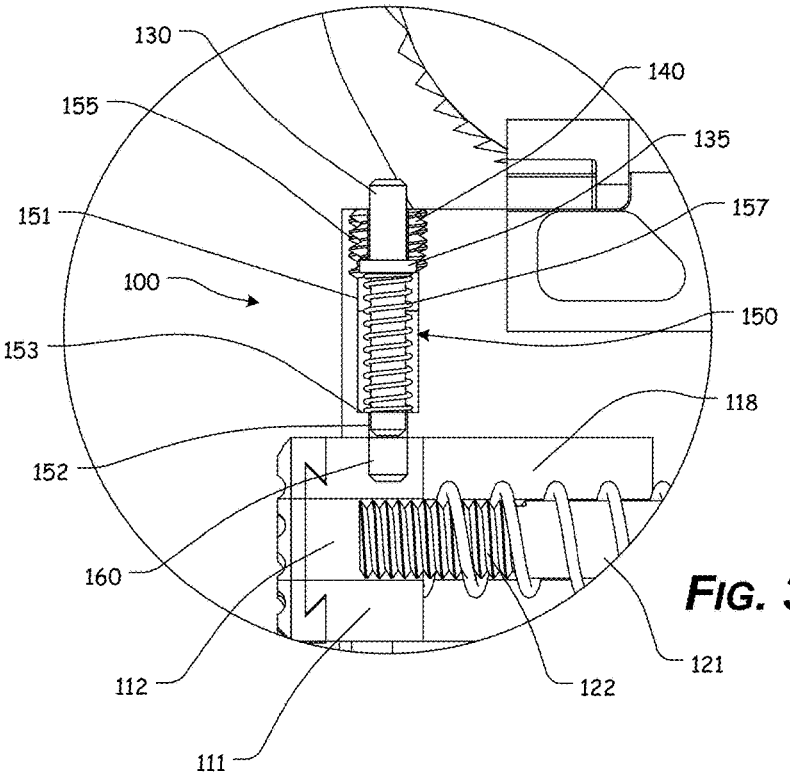
FIG. 34 illustrates a detailed, front, cross-sectional view showing the components of an exemplary embodiment of a magazine release block, wherein the blocking element is in a disengaged position, according to the present disclosure.
Figure 35:
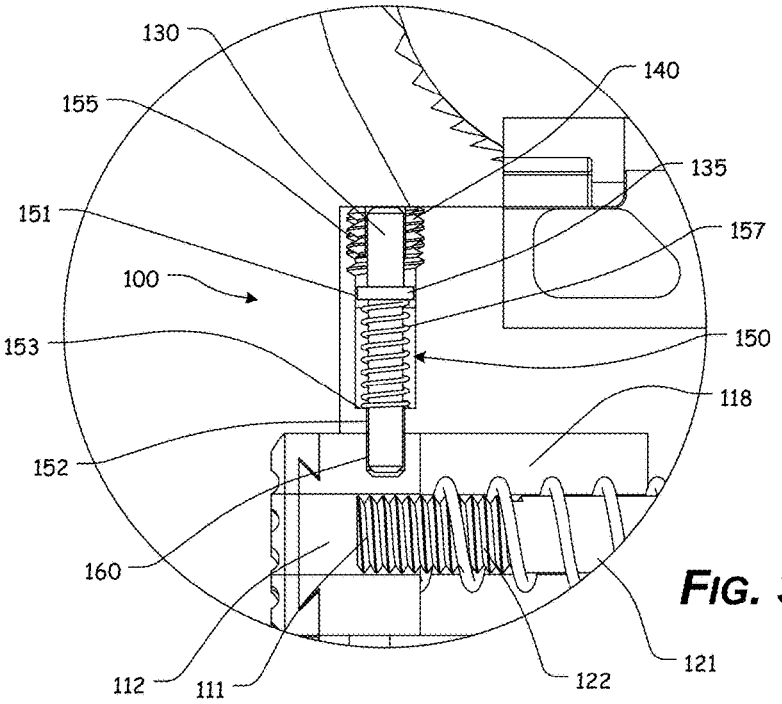
FIG. 35 illustrates a detailed, front, cross-sectional view showing the components of an exemplary embodiment of a magazine release block, wherein the blocking element is in an engaged position, according to the present disclosure.

FIGS. 34 and 35 illustrate an exemplary embodiment of a magazine release block 100 wherein the blocking element channel 150, blocking element 130, blocking element biasing spring 157, and set screw 140 are positioned relative to the lower receiver 106, such that when the blocking element 130 is in the engaged position, as illustrated in FIG. 34, at least a portion of the lower portion 138 extends into at least a portion of the magazine release blocking element recess 160 formed in the magazine release button 111. In this manner, the blocking element 130 can protrude into the magazine release button 111 body to lock the magazine release button 111. Thus, in the engaged position, the blocking element 130 can protrude into the magazine release button 111 body to lock the magazine release button 111, not merely extend behind at least a portion of the magazine release button 111.

In these exemplary embodiments, at least a portion of an outer wall of the lower receiver 106 may optionally extend so as to accommodate the position of the blocking element channel 150, blocking element 130, blocking element biasing spring 157, and set screw 140.

In certain exemplary embodiments, the blocking element 130 may be formed so as to be accommodated within the blocking element channel 150 as illustrated in FIGS. 8-19, but, when in an engaged position, extend into a magazine release blocking element recess 160 formed in the magazine release button 111, as opposed to extending into the magazine release button receiving cavity 118.

In still other exemplary embodiments, the magazine release button 111 may extend further into the magazine release button receiving cavity 118 so as to accommodate a magazine release blocking element recess 160, which can be engaged by a blocking element 130 positioned as illustrated in FIGS. 8-19.

Figure 36:
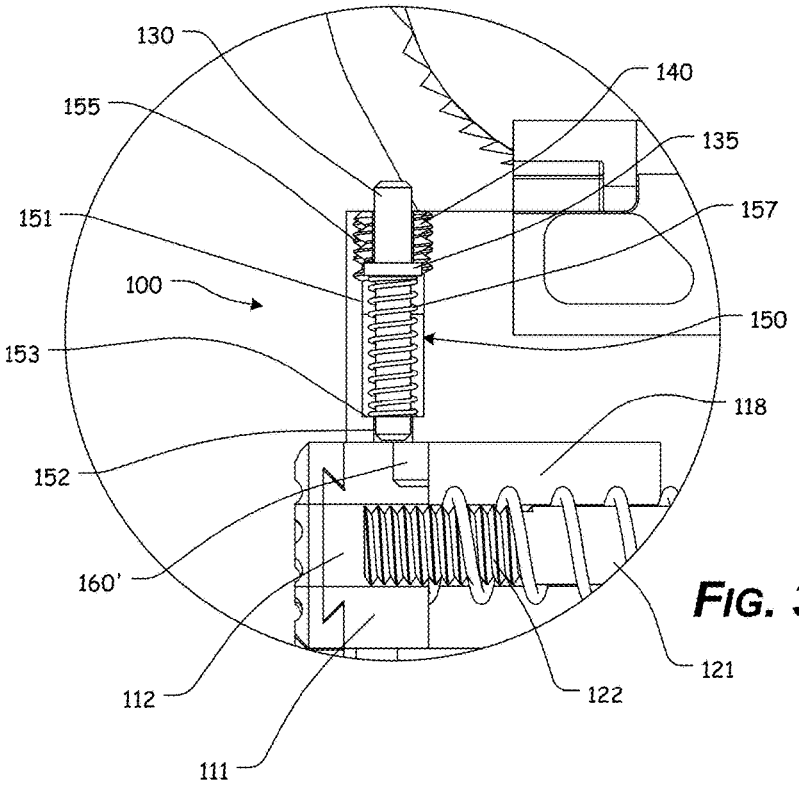
FIG. 36 illustrates a detailed, front, cross-sectional view showing the components of an exemplary embodiment of a magazine release block, wherein the blocking element is in a disengaged position, according to the present disclosure.
Figure 37:
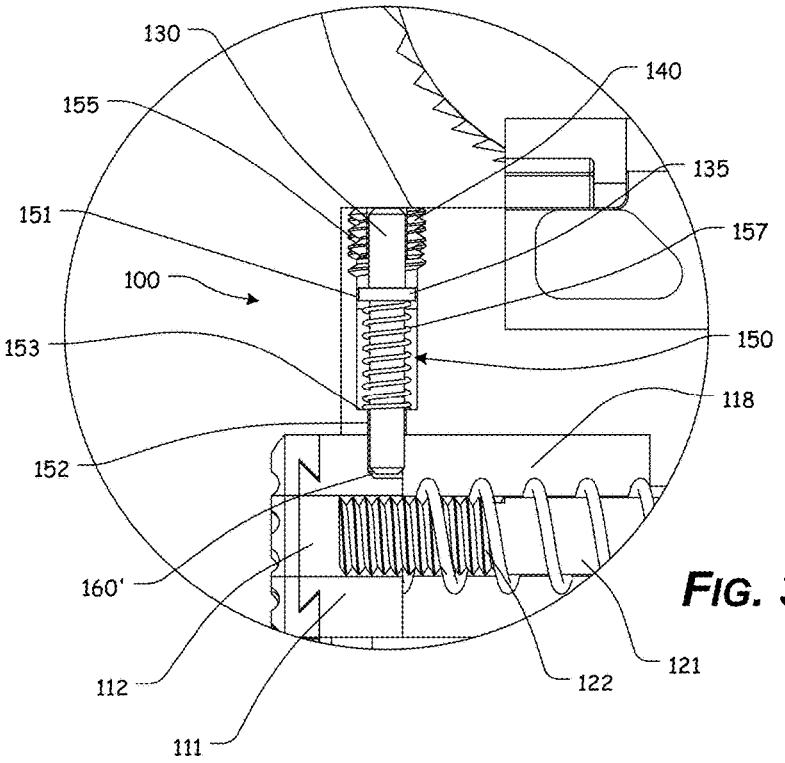
FIG. 37 illustrates a detailed, front, cross-sectional view showing the components of an exemplary embodiment of a magazine release block, wherein the blocking element is in an engaged position, according to the present disclosure.

FIGS. 36 and 37 illustrate an exemplary embodiment of a magazine release block 100 wherein the blocking element channel 150, blocking element 130, blocking element biasing spring 157, and set screw 140 are positioned relative to the lower receiver 106, such that when the blocking element 130 is in the engaged position, as illustrated in FIG. 37, at least a portion of the lower portion 138 extends into at least a portion of the magazine release blocking element recess 160' formed in a rear portion of the magazine release button 111. In this manner, the blocking element 130 can protrude into at least a portion of the magazine release button 111 body to block or otherwise inhibit movement of the magazine release button 111. Thus, in the engaged position, the blocking element 130 can protrude into at least a portion of the magazine release button 111, via interaction with the magazine release blocking element recess 160', to block the magazine release button 111, from being manipulated to allow a magazine to be released from the lower receiver 106.

Figure 38:
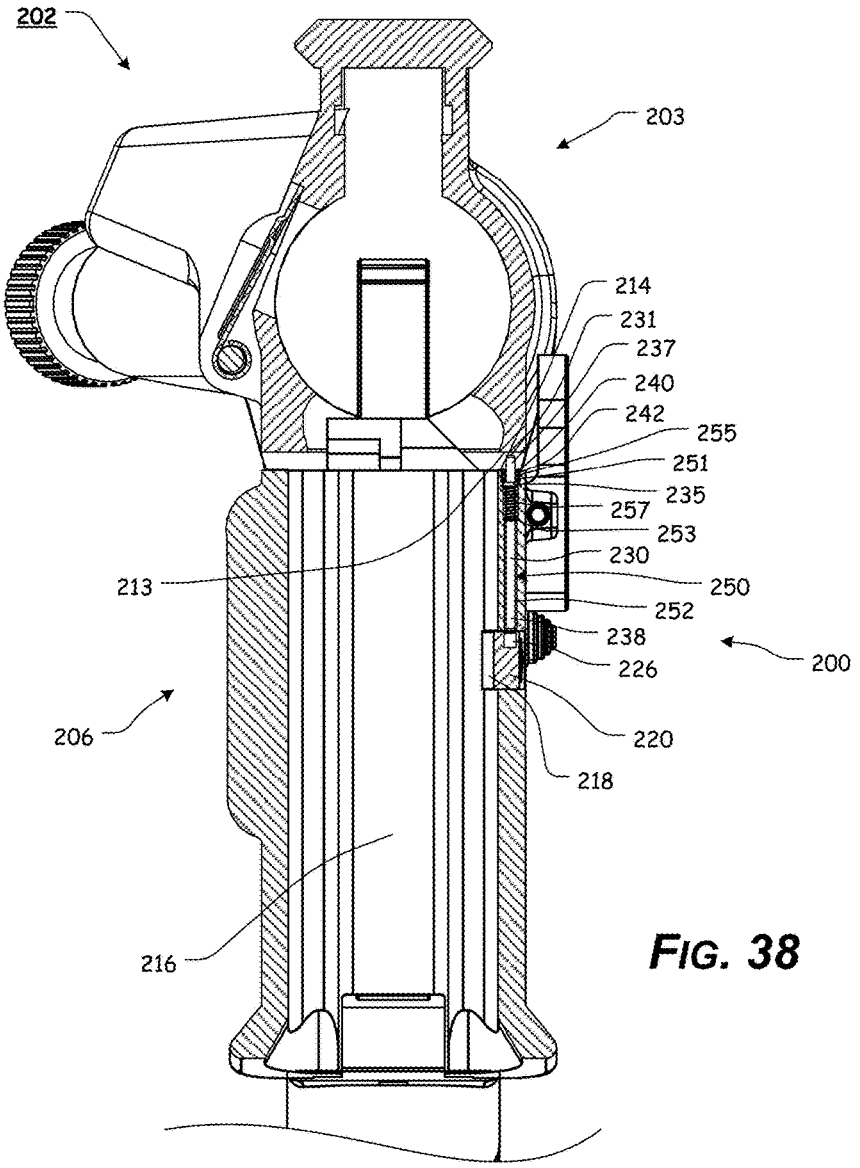
FIG. 38 illustrates a front, cross-sectional view showing the components of an exemplary embodiment of a magazine release block, wherein the blocking element is in a disengaged position, according to the present disclosure.
Figure 39:
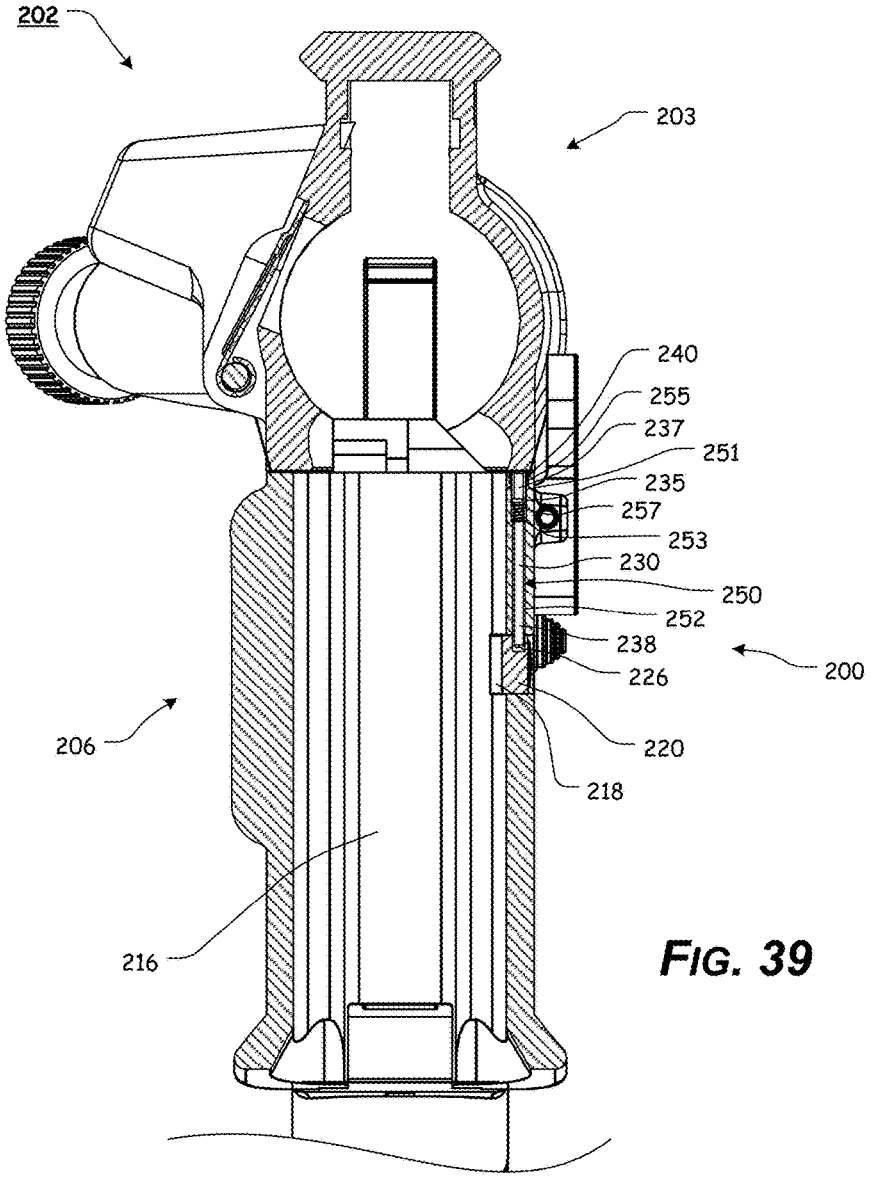
FIG. 39 illustrates a front, cross-sectional view showing the components of an exemplary embodiment of a magazine release block, wherein the blocking element is in an engaged position, according to the present disclosure.
Figure 40:
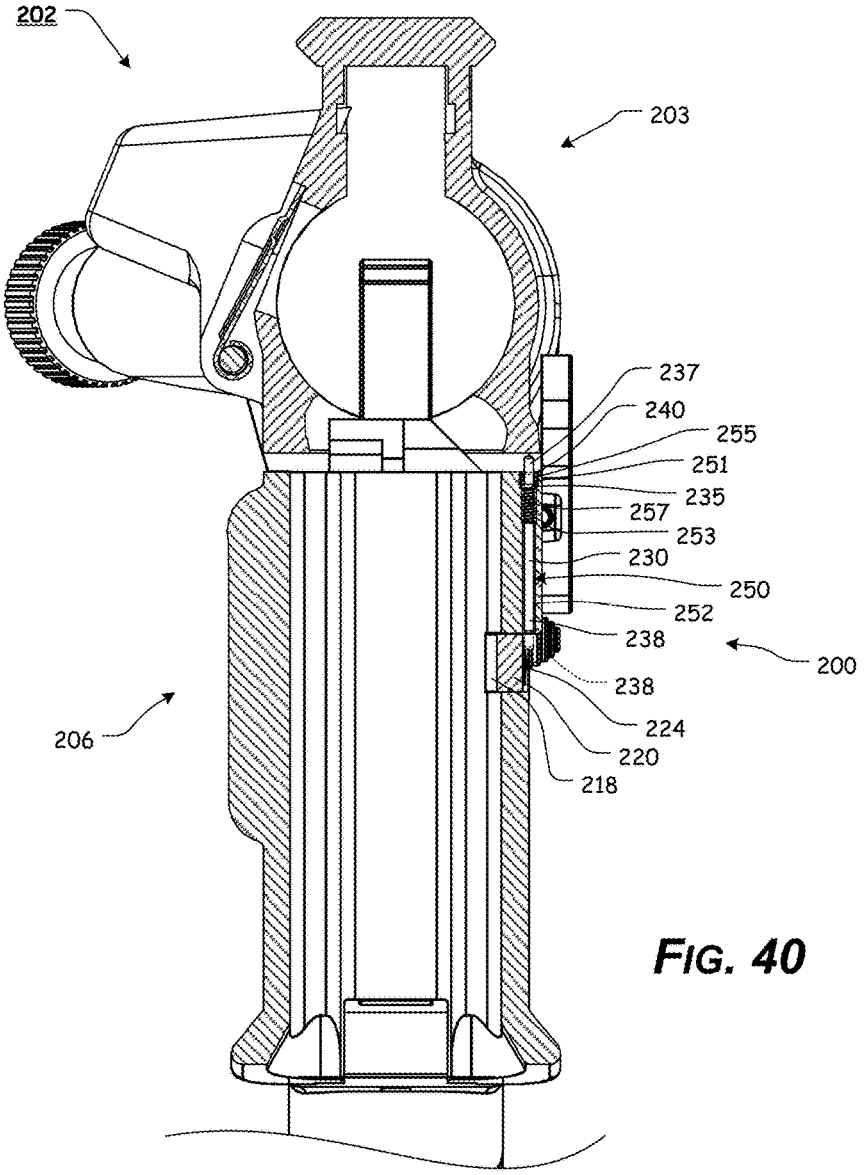
FIG. 40 illustrates a front, cross-sectional view showing the components of an exemplary embodiment of a magazine release block, wherein the blocking element is in a disengaged position (and illustrated in an engaged position in broken lines), according to the present disclosure.

FIGS. 38-40 illustrate certain elements or components of an exemplary embodiment of a magazine release block 200. In various exemplary, nonlimiting embodiments, the magazine release block 200 incorporates and/or interacts with at least some of a firearm 202, an upper receiver 203, a lower receiver 206, a magazine release button 211 (not shown) a magazine release 220 that travels back and forth within at least a portion of a magazine release receiving cavity 118, a blocking element 230, a set screw 240, a set screw aperture 242, a blocking element channel 250, a first pin channel portion 251, a second pin channel portion 252, a pin channel shoulder 253, a threaded pin channel portion 255, and a blocking element biasing spring 257.

It should be appreciated that these elements correspond to and are substantially similar in form and/or function to the firearm 102, the upper receiver 103, the lower receiver 106, the magazine release button 111 (not shown) the magazine release 120, the blocking element 130, the set screw 140, the set screw aperture 142, the blocking element channel 150, the first pin channel portion 151, the second pin channel portion 152, the pin channel shoulder 153, the threaded pin channel portion 155, and the blocking element biasing spring 157, as described herein.

However, as illustrated in FIGS. 38-40, the magazine release block 200 comprises a blocking element 230 that is slidably positioned within the blocking element channel 250 formed in a portion of the lower receiver 206 of a firearm 202. The blocking element 230 is slidable between a disengaged position (as illustrated most clearly in FIG. 38) and an engaged position (as illustrated most clearly in FIG. 39).

The blocking element channel 250 is formed in a portion of the lower receiver 206, proximate the magazine release 220. As compared to the blocking element 130, the length of the lower portion 238 of the blocking element 230 and/or the length of the upper portion 237 of the blocking element 230 may be longer than those portions of the blocking element 130. It should be appreciated that the length of the upper portion 237, the lower portion 238, and/or the blocking element 230 is a design choice based upon the dimensions of the lower receiver 206 of the firearm 202.

The blocking element 230 is repeatably slidable between the engaged position and the disengaged position. In the engaged position, at least a portion of the lower portion 238 of the blocking element 230 is urged within at least a portion of the magazine release blocking element recess 226 formed in a portion of the magazine release 220. In this manner, the blocking element 230 can protrude into a portion of the magazine release 220 to lock the magazine release 220. Thus, in the engaged position, the blocking element 230 can protrude into a portion of the magazine release 220 to lock the magazine release 220, such that the magazine release 220 cannot be urged outside of the magazine well, such that the magazine engagement projection 223 (not shown) cannot be withdrawn from an inserted magazine (thereby not allowing an inserted magazine to be removed from the magazine well) or can block insertion of a magazine into the magazine well 216.

Thus, in the engaged position, at least a portion of the lower portion 238 of the blocking element 230 blocks or obstructs movement of the magazine release 220 such that the magazine release button 211 cannot be manipulated to allow a magazine to be removed (or potentially inserted) into the magazine well 216.

In the disengaged position, the spring bias of the blocking element biasing spring 257 urges the blocking element 230 such that at least a portion of the upper portion 237 of the blocking element 230 extends above the upper surface 214 of the lower receiver 206. At the same time, the lower portion 238 of the blocking element 230 is withdrawn from the magazine release blocking element recess 226. In this manner, the magazine release button 211 remains free to be manipulated such that a magazine can be inserted or withdrawn from the magazine well 216 of the firearm 202.

In various exemplary embodiments, the blocking element 230 is positioned such that when the upper receiver 203 is operably attached or coupled to the lower receiver 206 (as is required in order to be able to fire the firearm 202) a lower surface 213 of the upper receiver 203 makes contact with the top surface 231 of the blocking element 230 and urges the blocking element 230 to the engaged position. Thus, while the upper receiver 203 is operably attached or coupled to the lower receiver 206, the blocking element 230 remains in the engaged position. When in the engaged position, as illustrated in FIG. 39, at least a portion of the blocking element 230 keeps the magazine release 220 from moving a sufficient distance to urge the magazine engagement projection 223 a sufficient distance to disengage from an inserted magazine and allow the inserted magazine to be released or removed from the magazine well 216 or allow a magazine to be operably inserted within the magazine well 216 of the firearm 202.

In order to utilize the magazine release button 211 to insert a magazine into the magazine well 216 or remove an inserted magazine from the magazine well 216, the blocking element 230 must be in the disengaged position. In the disengaged position, the blocking element 230 is retracted such that the magazine release button 211 may be depressed a sufficient distance to urge the magazine release 220 and the magazine engagement projection 223 a sufficient distance to disengage from an inserted magazine and allow the inserted magazine to be released or removed from the magazine well 216.

In order to be in the disengaged position, the upper receiver 203 must at least be partially rotated away from, separated from, or removed from the lower receiver 206, as illustrated in FIG. 38. When the upper receiver 203 is sufficiently rotated away from, separated from, or removed from the lower receiver 206 for the blocking element 230 to be urged into the disengaged position, the firearm 202 is in an inoperable state and cannot be fired.

Thus, it should be appreciated that the blocking element 230 may be urged into the disengaged position when the upper receiver 203 and the lower receiver 206 are at least partially rotated away from one another, separated from one another, or completely removed from one another.

As illustrated in FIG. 40, the blocking element channel 250 is formed such that when the blocking element 230 is in the engaged position (as illustrated in broken lines in FIG. 40), at least a portion of the lower portion 238 of the blocking element 230 extends proximate an exterior or outward facing surface 224 of the magazine release 220 and keeps the magazine release 220 from moving a sufficient distance to urge the magazine engagement projection 223 a sufficient distance to disengage from an inserted magazine and allow the inserted magazine to be released or removed from the magazine well 216 or allow a magazine to be operably inserted within the magazine well 216 of the firearm 202.

Figure 41:
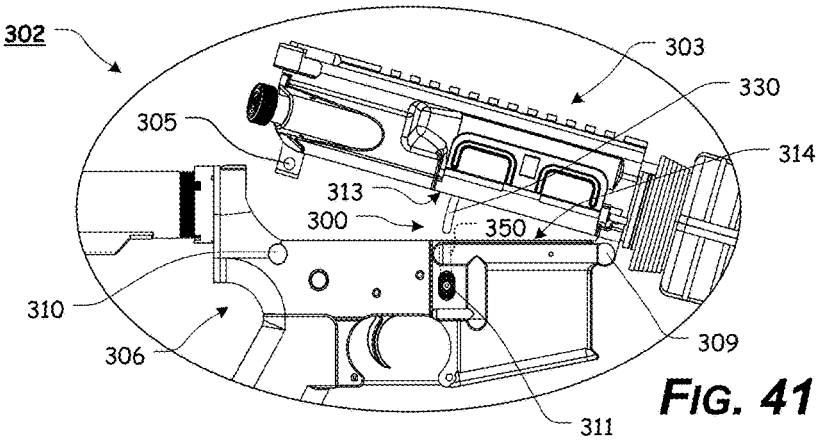
FIG. 41 illustrates a side view showing certain exemplary components of an exemplary embodiment of a magazine release block, wherein the upper receiver and the lower receiver are in an inoperable position and the blocking element is in a disengaged position, according to the present disclosure.
Figure 42:
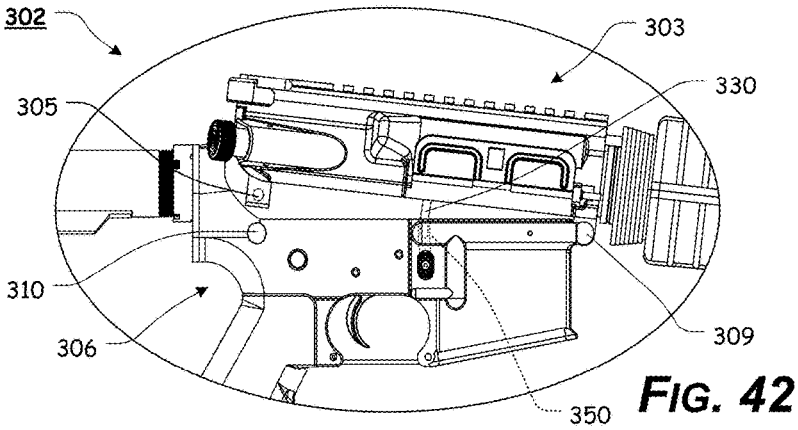
FIG. 42 illustrates a side view showing certain exemplary components of an exemplary embodiment of a magazine release block, wherein the upper receiver and the lower receiver are in an inoperable position and the blocking element is in a disengaged position, according to the present disclosure.
Figure 43:
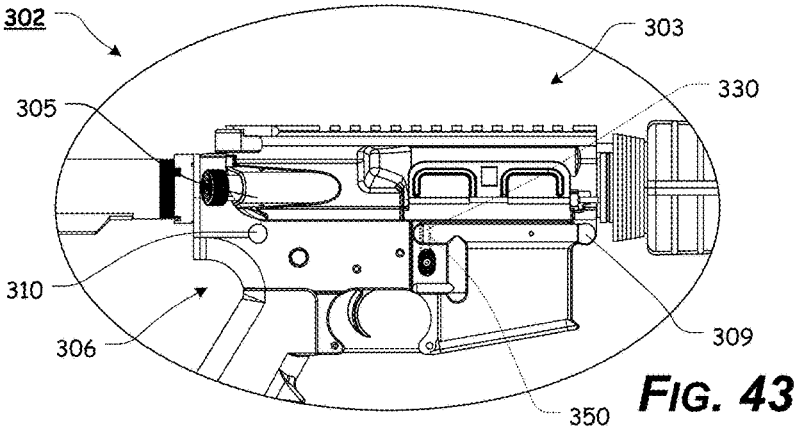
FIG. 43 illustrates a side view showing certain exemplary components of an exemplary embodiment of a magazine release block, wherein the upper receiver and the lower receiver are in an operable position and the blocking element is in an engaged position, according to the present disclosure.

FIGS. 41-43 illustrate certain elements or components of an exemplary embodiment of a magazine release block 300. In various exemplary, nonlimiting embodiments, the magazine release block 300 incorporates and/or interacts with at least some of a firearm 302, an upper receiver 303 having a lower surface 313, an upper pivot pin lug aperture 304 (not shown), an upper take-down lug aperture 305, a lower receiver 306, a lower pivot pin lug apertures 307 (not shown), a lower take-down lug apertures 308 (not shown), a pivot pin 309, a take-down pin 310, a magazine release button 311 having the internal aperture 312 (not shown) and the associated magazine release spring 315 (not shown), a magazine release button receiving cavity 318 (not shown), a magazine release 320 (not shown), a magazine release connection shaft 321 (not shown), a threaded portion 322 (not shown), a magazine engagement projection 323 (not shown).

It should be appreciated that these elements correspond to and are substantially similar in form and/or function to the firearm 102, the upper receiver 103 with the lower surface 113, the upper pivot pin lug aperture 104 (not shown), the upper take-down lug aperture 105, the lower receiver 106, the lower pivot pin lug apertures 107, the lower take-down lug apertures 108, the pivot pin 109, the take-down pin 110, the magazine release button 111 having the internal aperture 112 and the associated magazine release spring 115, the magazine release button receiving cavity 118, the magazine release 120, the magazine release connection shaft 121, the threaded portion 122, and the magazine engagement projection 123, as described herein.

However, as illustrated in FIGS. 41-43, in certain illustrative, non-limiting embodiment(s) of the present disclosure, a blocking element 330 extends from at least a portion of a lower surface 313 of the upper receiver 303. In various exemplary embodiments, the blocking element 330 comprises an elongate protrusion or extension having a sufficient length to extend to block or otherwise obstruct at least a portion of the magazine release button 311, when in an engaged position.

A blocking element channel 350 is formed so as to extend between an upper surface 314 of the lower receiver 306 and an internal, magazine release button receiving cavity 318 (not shown).

In various exemplary embodiments, the blocking element 330 is substantially arcuate, so as to be received within a substantially similarly shaped blocking element channel 350 as the upper receiver 303 pivots on the pivot pin 309. However, in various exemplary, nonlimiting embodiments, the blocking element 330 may optionally have a substantially circular, oval, oblong, rectangular, square, triangular, or other profile, or may comprise a pin, a plate, a bar, or other shape. It should be appreciated that the blocking element channel 350 comprises a shape that allows the blocking element 330 to move within at least a portion of the blocking element 330 to function as outlined herein.

The blocking element 330 is slidable between an engaged position (as illustrated most clearly in FIG. 43) and a disengaged position (as illustrated most clearly in FIGS. 41 and 42).

In order to utilize the magazine release button 311 to insert a magazine into the magazine well 316 or remove an inserted magazine from the magazine well 316, the blocking element 330 must be in the disengaged position (as illustrated most clearly in FIGS. 41 and 42). In the disengaged position, the blocking element 330 is retracted a sufficient distance such that the magazine release button 311 may be depressed a sufficient distance to urge the magazine release 320 and the magazine engagement projection 323 a sufficient distance to disengage from an inserted magazine and allow the inserted magazine to be released or removed from the magazine well 316.

In order to be in the disengaged position, the upper receiver 303 must at least be partially rotated away from, separated from, or removed from the lower receiver 306, as illustrated most clearly in FIGS. 41 and 42. When the upper receiver 303 is sufficiently rotated away from, separated from, or removed from the lower receiver 306 for the blocking element 330 to be urged into the disengaged position, the firearm 302 is in an inoperable state and cannot be fired.

Thus, it should be appreciated that the blocking element 330 may be urged into the disengaged position when the upper receiver 303 and the lower receiver 306 are at least partially rotated away from one another, separated from one another, or completely removed from one another.

As illustrated in FIG. 43, when the blocking element 330 is in the engaged position (as illustrated in broken lines in FIG. 43), at least a portion of the blocking element 330 extends into or behind the magazine release button 311 and keeps the magazine release button 311 and, in turn, the magazine release 320 from moving a sufficient distance to urge the magazine engagement projection 323 a sufficient distance to disengage from an inserted magazine and allow the inserted magazine to be released or removed from the magazine well 316 or allow a magazine to be operably inserted within the magazine well 316 of the firearm 302.

FIGS. 44-48 illustrate certain elements or components of an exemplary embodiment of a magazine release block 400. In various exemplary, nonlimiting embodiments, the magazine release block 400 incorporates and/or interacts with at least some of a firearm 402, an upper receiver 403 having a lower surface 413, an upper pivot pin lug aperture 404 (not shown), an upper take-down lug aperture 405, a lower receiver 406, a lower pivot pin lug apertures 407 (not shown), a lower take-down lug apertures 408 (not shown), a pivot pin 409, a take-down pin 410, a magazine release button 411 (not shown) having the internal aperture 412 (not shown) and the associated magazine release spring 415 (not shown), a magazine release button receiving cavity 418 (not shown), a magazine release 420, a magazine release connection shaft 421, a threaded portion 422 (not shown), a magazine engagement projection 423 (not shown).

It should be appreciated that these elements correspond to and are substantially similar in form and/or function to the firearm 102, the upper receiver 103 with the lower surface 113, the upper pivot pin lug aperture 104 (not shown), the upper take-down lug aperture 105, the lower receiver 106, the lower pivot pin lug apertures 107, the lower take-down lug apertures 108, the pivot pin 109, the take-down pin 110, the magazine release button 111 having the internal aperture 112 and the associated magazine release spring 115, the magazine release button receiving cavity 118, the magazine release 120, the magazine release connection shaft 121, the threaded portion 122, and the magazine engagement projection 123, as described herein.

However, as illustrated in FIGS. 44-48, in certain illustrative, non-limiting embodiment(s) of the present disclosure, a blocking element 430 extends from at least a portion of a side portion or a lower surface 413 of the upper receiver 403. In various exemplary embodiments, the blocking element 430 comprises an elongate protrusion or extension having a sufficient length to extend to block or otherwise obstruct at least a portion of the magazine release 420, when in an engaged position.

In various exemplary embodiments, the blocking element 430 is substantially arcuate, so as to maintain a position relative to the lower receiver 406 as the upper receiver 403 pivots on the pivot pin 409. However, in various exemplary, nonlimiting embodiments, the blocking element 430 may optionally have a substantially circular, oval, oblong, rectangular, square, triangular, or other profile, or may comprise a pin, a plate, a bar, or other shape.

Figure 44:
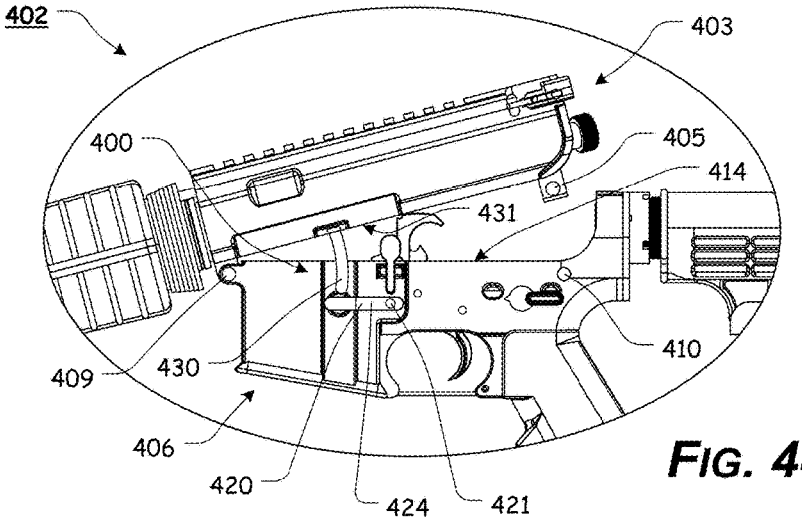
FIG. 44 illustrates a side view showing certain exemplary components of an exemplary embodiment of a magazine release block, wherein the upper receiver and the lower receiver are in an inoperable position and the blocking element is in a disengaged position, according to the present disclosure.
Figure 45:
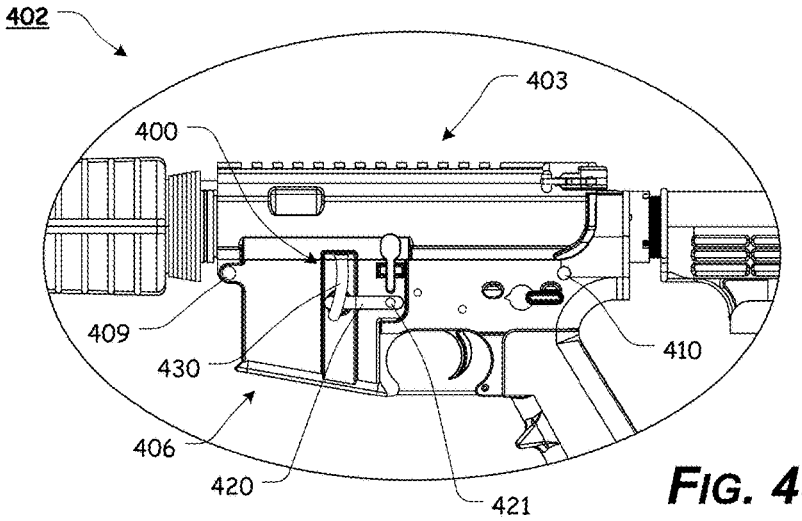
FIG. 45 illustrates a side view showing certain exemplary components of an exemplary embodiment of a magazine release block, wherein the upper receiver and the lower receiver are in an operable position and the blocking element is in an engaged position, according to the present disclosure.
Figure 46:
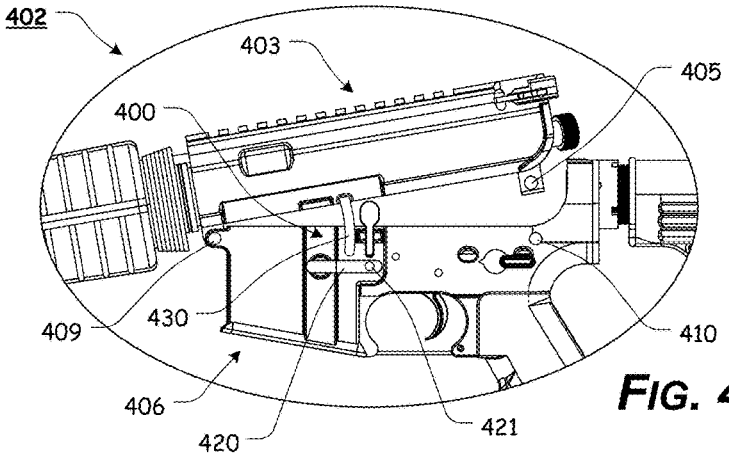
FIG. 46 illustrates a side view showing certain exemplary components of an exemplary embodiment of a magazine release block, wherein the upper receiver and the lower receiver are in an inoperable position and the blocking element is in a disengaged position, according to the present disclosure.

As the upper receiver 403 is pivoted relative to the lower receiver 406, the blocking element 430 is moved between an engaged position (as illustrated most clearly in FIGS. 45, 47, and 48) and a disengaged position (as illustrated most clearly in FIGS. 44 and 46).

In order to utilize the magazine release button 411 to insert a magazine into the magazine well 416 or remove an inserted magazine from the magazine well 416, the blocking element 430 must be in the disengaged position (as illustrated most clearly in FIGS. 44 and 46). In the disengaged position, the blocking element 430 is retracted a sufficient distance such that the magazine release button 411 may be depressed a sufficient distance to urge the magazine release 420 and the magazine engagement projection 423 a sufficient distance to disengage from an inserted magazine and allow the inserted magazine to be released or removed from the magazine well 416.

In order to be in the disengaged position, the upper receiver 403 must at least be partially rotated away from, separated from, or removed from the lower receiver 406, as illustrated most clearly in FIGS. 41 and 42. When the upper receiver 403 is sufficiently rotated away from, separated from, or removed from the lower receiver 406 for the blocking element 430 to be urged into the disengaged position, the firearm 402 is in an inoperable state and cannot be fired.

Thus, it should be appreciated that the blocking element 430 may be urged into the disengaged position when the upper receiver 403 and the lower receiver 406 are at least partially rotated away from one another, separated from one another, or completely removed from one another.

Figure 47:
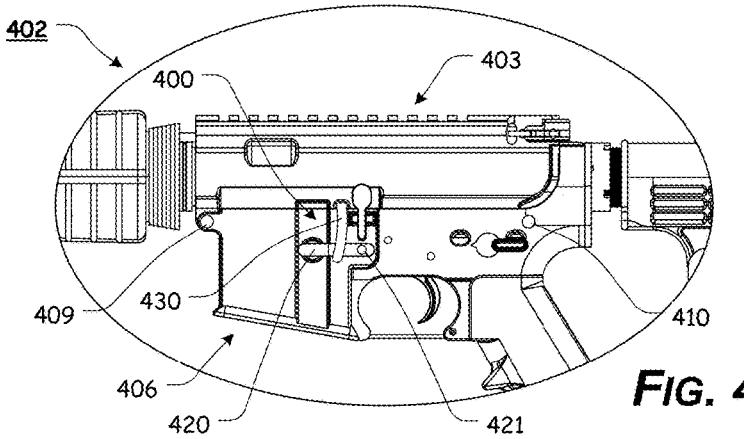
FIG. 47 illustrates a side view showing certain exemplary components of an exemplary embodiment of a magazine release block, wherein the upper receiver and the lower receiver are in an operable position and the blocking element is in an engaged position, according to the present disclosure.
Figure 48:
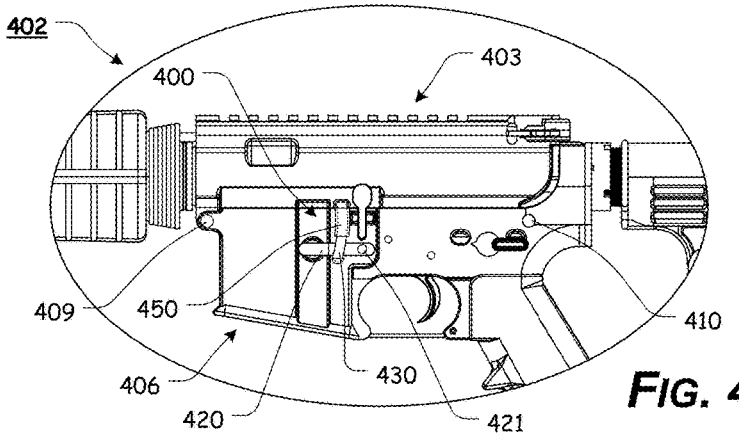
FIG. 48 illustrates a side view showing certain exemplary components of an exemplary embodiment of a magazine release block, wherein the upper receiver and the lower receiver are in an operable position and the blocking element is in an engaged position, according to the present disclosure.

As illustrated in FIGS. 45, 47, and 48, when the blocking element 430 is in the engaged position, at least a portion of the blocking element 430 extends proximate an exterior or outward facing surface 424 of the magazine release 420 and keeps the magazine release 420 from moving a sufficient distance to urge the magazine engagement projection 423 a sufficient distance to disengage from an inserted magazine and allow the inserted magazine to be released or removed from the magazine well 416 or allow a magazine to be operably inserted within the magazine well 416 of the firearm 402.

As illustrated in FIG. 48, a partial or complete blocking element channel 450 may optionally be formed so as to extend between at least a portion of an upper surface 414 of the lower receiver 406 and the magazine release 420. In certain exemplary embodiments, the blocking element channel 450 may extend from at least a portion of the lower receiver 406, beyond the magazine release 420.

In various exemplary embodiments, the blocking element 430 is substantially arcuate, so as to be received within a substantially arcuate blocking element channel 450 as the upper receiver 403 pivots on the pivot pin 409. However, in various exemplary, nonlimiting embodiments, the blocking element 430 may optionally have a substantially circular, oval, oblong, rectangular, square, triangular, or other profile, or may comprise a pin, a plate, a bar, or other shape. It should be appreciated that the blocking element channel 450 comprises a shape that allows the blocking element 430 to move within at least a portion of the blocking element 430 to function as outlined herein.

While the present disclosure has been described in conjunction with the exemplary embodiments outlined above, the foregoing description of exemplary embodiments of the disclosure, as set forth above, are intended to be illustrative, not limiting and the fundamental disclosed systems, methods, and/or apparatuses of the present disclosure should not be considered to be necessarily so constrained. It is evident that the present disclosure is not limited to the particular variation set forth and many alternatives, adaptations modifications, and/or variations will be apparent to those skilled in the art.

It is to be understood that the phraseology of terminology employed herein is for the purpose of description and not of limitation. Unless defined otherwise, all technical and scientific terms used herein have the same meaning as commonly understood by one of ordinary skill in the art to which the present disclosure belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the disclosure, such that others may, by applying current knowledge, change, vary, modify, and/or adapt these exemplary, nonlimiting embodiments for various applications without departing from the spirit and scope of the disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the disclosure.

Also, it is noted that as used herein and in the appended claims, the singular forms “a”, “and”, “said”, and “the” include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as “solely”, "only", and the like in connection with the recitation of claim elements or the use of a "negative" claim limitation(s).

What is claimed is:

1. A firearm and a magazine release block, said magazine release block comprising:

an elongate blocking element extending from a portion of an upper receiver of said firearm;

wherein if said upper receiver of said firearm is operably positioned atop a lower receiver of said firearm, at least a portion of said elongate blocking element extends so as to inhibit movement of a magazine release button of said lower receiver.

2. The magazine release block of claim 1, wherein if said upper receiver of said firearm is operably positioned atop said lower receiver of said firearm, at least a portion of said elongate blocking element extends behind at least a portion of said magazine release button.

3. The magazine release block of claim 1, wherein if said upper receiver of said firearm is operably positioned atop said lower receiver of said firearm, at least a portion of said elongate blocking element extends within at least a portion of a magazine release of said lower receiver.

4. The magazine release block of claim 1, wherein if said upper receiver of said firearm is operably positioned atop said lower receiver of said firearm, at least a portion of said elongate blocking element extends to block at least a portion of a magazine release of said lower receiver.

* * * * *